US010569849B2

(12) United States Patent
Stone et al.

(10) Patent No.: US 10,569,849 B2
(45) Date of Patent: Feb. 25, 2020

(54) METHOD OF RETRIEVAL FOR AUTONOMOUS UNDERWATER VEHICLES

(71) Applicant: Stone Aerospace, Inc., Del Valle, TX (US)

(72) Inventors: William C. Stone, Del Valle, TX (US); Evan Clark, Pasedena, CA (US); Kristof Richmond, Miami, FL (US); Jeremy Paulus, Santa Clara, CA (US); Jason Kapit, Pocasset, MA (US); Mark Scully, Portland, OR (US); Peter Kimball, Palo Alto, CA (US)

(73) Assignee: Stone Aerospace, Inc., Del Valle, TX (US)

( * ) Notice: Subject to any disclaimer, the term of this patent is extended or adjusted under 35 U.S.C. 154(b) by 297 days.

(21) Appl. No.: 15/876,507

(22) Filed: Jan. 22, 2018

(65) Prior Publication Data

US 2018/0154994 A1 Jun. 7, 2018

Related U.S. Application Data

(62) Division of application No. 14/887,262, filed on Oct. 19, 2015, now Pat. No. 9,873,495.

(Continued)

(51) Int. Cl.
*B63G 8/00* (2006.01)
*B63B 27/16* (2006.01)

(52) U.S. Cl.
CPC ..... *B63G 8/001* (2013.01); *B63B 2027/165* (2013.01); *B63B 2231/76* (2013.01);

(Continued)

(58) Field of Classification Search
CPC ..... B63B 2027/165; B63B 2231/76; B63B 2702/12; B63G 2008/008; B63G 8/001; B63G 2008/004
See application file for complete search history.

(56) References Cited

U.S. PATENT DOCUMENTS 3,753,537 A 8/1973 Karpa et al.
3,809,002 A * 5/1974 Nagy ..... B63B 21/58 114/249

(Continued)

FOREIGN PATENT DOCUMENTS

JP 2001132542 A 5/2001
JP 2002193555 A 7/2002

OTHER PUBLICATIONS

Dughaish, Z.H., Lead telluride as a thermoelectric material for thermoelectric power generation, Physica 8: Condensed Matter, vol. 322, Issues 1-2, 2002, pp. 205-223.

(Continued)

*Primary Examiner* — Adam R Mott
(74) *Attorney, Agent, or Firm* — Miguel Villarreal, Jr.; Gunn, Lee & Cave, P.C.

(57) ABSTRACT

A system for automated rendezvous, docking, and capture of autonomous underwater vehicles at the conclusion of a mission comprising of comprised of a docking rod having lighted, pulsating (in both frequency and light intensity) series of LED light strips thereon, with the LEDs at a known spacing, and the autonomous underwater vehicle specially designed to detect and capture the docking rod and then be lifted structurally by a spherical end strop about which the vehicle can be pivoted and hoisted up (e.g., onto a ship). The method of recovery allows for very routine and reliable automated recovery of an unmanned underwater asset.

5 Claims, 26 Drawing Sheets

Related U.S. Application Data

(60) Provisional application No. 62/094,680, filed on Dec. 19, 2014.

(52) U.S. Cl.
CPC .... *B63B 2702/12* (2013.01); *B63G 2008/004* (2013.01); *B63G 2008/008* (2013.01)

(56) References Cited

U.S. PATENT DOCUMENTS

| | | | |
|---|---|---|---|
| 3,815,511 | A | 5/1974 | Staal |
| 3,825,211 | A | 7/1974 | Minovitch |
| 4,860,968 | A | 8/1989 | Pinson |
| 5,022,603 | A | 6/1991 | Maree et al. |
| 5,039,193 | A | 6/1991 | Snow et al. |
| 5,044,573 | A | 9/1991 | LeCompte |
| 5,058,969 | A | 10/1991 | Peterson et al. |
| 5,074,489 | A | 12/1991 | Gamzon |
| 5,099,144 | A | 3/1992 | Yukio |
| 5,248,931 | A | 9/1993 | Flesner et al. |
| 5,260,639 | A | 11/1993 | De Young et al. |
| 5,310,134 | A | 5/1994 | Hsu et al. |
| 5,436,553 | A | 7/1995 | Pepper et al. |
| 5,502,356 | A | 3/1996 | McGeoch |
| 5,564,649 | A | 10/1996 | Von Hoessle et al. |
| 5,686,694 | A | 11/1997 | Hillenbrand et al. |
| 5,748,102 | A | 5/1998 | Barron |
| 6,167,831 | B1 | 1/2001 | Watt et al. |
| 6,223,675 | B1 | 5/2001 | Watt et al. |
| 6,257,162 | B1 | 7/2001 | Watt et al. |
| 6,262,357 | B1 | 7/2001 | Johnson et al. |
| 6,307,156 | B1 | 10/2001 | Avellanet |
| 6,390,012 | B1 | 5/2002 | Watt et al. |
| 6,407,535 | B1 | 6/2002 | Friedman et al. |
| 6,411,565 | B1 | 6/2002 | Sirmalis et al. |
| 6,488,233 | B1 | 12/2002 | Myrabo |
| 6,491,258 | B1 | 12/2002 | Boyd et al. |
| 6,534,705 | B2 | 3/2003 | Berrios et al. |
| 6,669,126 | B1 | 12/2003 | Albert et al. |
| 6,828,579 | B2 | 12/2004 | Ghamaty et al. |
| 6,910,658 | B1 | 6/2005 | Hart et al. |
| 6,914,343 | B2 | 7/2005 | Hiller et al. |
| 6,964,509 | B2 | 11/2005 | Gozum et al. |
| 6,968,112 | B2 | 11/2005 | Zamel et al. |
| 7,263,245 | B2 | 8/2007 | Delcher et al. |
| 7,342,170 | B2 | 3/2008 | Ghamaty et al. |
| 7,356,209 | B2 | 4/2008 | Delcher et al. |
| 7,540,265 | B2 | 6/2009 | Willems et al. |
| 8,145,369 | B1 * | 3/2012 | Tureaud ..... B63B 21/66 701/1 |
| 2002/0046763 | A1 | 4/2002 | Berrios et al. |
| 2003/0111660 | A1 | 6/2003 | Ghamaty et al. |
| 2004/0149485 | A1 | 8/2004 | Edwards |
| 2004/0163709 | A1 | 8/2004 | Baugh et al. |
| 2004/0163802 | A1 | 8/2004 | Baugh et al. |
| 2004/0182732 | A1 | 9/2004 | Zamel et al. |
| 2004/0238022 | A1 | 12/2004 | Hiller et al. |
| 2005/0028857 | A1 | 2/2005 | Ghamaty et al. |
| 2005/0126624 | A1 | 6/2005 | Pellizzari |
| 2006/0289724 | A1 | 12/2006 | Skinner et al. |
| 2007/0056262 | A1 | 3/2007 | Leach et al. |
| 2008/0056642 | A1 | 3/2008 | Byer et al. |
| 2008/0134952 | A1 | 6/2008 | Tull |
| 2009/0086309 | A1 | 4/2009 | Moosburger |
| 2009/0206697 | A1 | 8/2009 | Marshall et al. |
| 2009/0251271 | A1 | 10/2009 | Stelzer et al. |
| 2009/0296746 | A1 | 12/2009 | Heaton et al. |
| 2010/0044103 | A1 | 2/2010 | Moxley et al. |
| 2010/0044106 | A1 | 2/2010 | Zediker et al. |
| 2010/0215326 | A1 | 8/2010 | Zediker et al. |
| 2010/0275576 | A1 | 11/2010 | Gutman et al. |
| 2012/0006245 | A1 * | 1/2012 | Lundberg ..... B63G 8/001 114/244 |
| 2012/0068086 | A1 | 3/2012 | DeWitt et al. |

OTHER PUBLICATIONS

Hecht, Jeff, Photonic Frontiers: Photonic power delivery: Photonic power conversion delivers power via laser beams, 2006, Laser Focus World, available at https://www.laserfocusworld.com/articles/print!volume-42/issue-1/features/photonic-frontiersphotonic-power-delivery-photonic-power-conversion-delivers-power-via-laser-beams.html.

Hussein, H., A novel delivery for laser thermal recanalization, Images of the Twenty-First Century. Proceedings of the Annual International Engineering in Medicine and Biology Society, Seattle, WA, 1989, pp. 1190-1191 vol. 4.

Lorenz, R.D., Subsurface ambient thermoelectric power for moles and penetrators, 2003 IEEE Aerospace Conference Proceedings (Cat. No. 03TH8652), 2003, pp. 2_637-2_642.

Ritz et al., Multi-mission radioisotope thermoelectric generator (MMRTG) program overview, 20041EEE Aerospace Conference Proceedings (IEEE Cat. No. 04TH8720), 2004, pp. 2957 vol. 5.

* cited by examiner

300

312

310

310

400

METHOD OF RETRIEVAL FOR AUTONOMOUS UNDERWATER VEHICLES

CROSS REFERENCE TO RELATED APPLICATIONS

This is a divisional application claiming priority to and the benefit of application Ser. No. 14/887,262, filed Oct. 19, 2015, and entitled "System and Method for Automated Rendezvous, Docking and Capture of Autonomous Underwater Vehicles," which claims priority to and the benefit of U.S. provisional application Ser. No. 62/094,680, filed Dec. 19, 2014, and entitled "Autonomous Rover/Airborne-Radar Transects of the Environment Beneath the McMurdo Ice Shelf," both of which are incorporated by reference herein.

STATEMENT REGARDING FEDERALLY SPONSORED RESEARCH OR DEVELOPMENT

This invention was made with Government support under Grant No. NNX12AL65G awarded by NASA. The Government has certain rights in this invention.

BACKGROUND OF THE INVENTION

1. Field of the Invention

The present invention relates to an automated rendezvous and docking (ARD) system. More specifically, the present invention relates to a system and method for automated rendezvous and docking (ARD) for autonomous underwater vehicles (AUVs) for mapping, inspection and intervention that allows for very routine and reliable automated recovery of an unmanned underwater asset.

2. Description of the Related Art

Autonomous underwater vehicles exist in the art and are used to perform highly complex missions, sometimes in extreme environmental conditions. Many times, such missions are carried out in less than pristine and/or extremely deep waters where visibility is limited. Probably the highest risk operation for these AUVs is failing to recovery them after completion of—or even during—a mission. A failed docking could result in the complete loss of the vehicle on any given mission, the consequence of which can be multi-million dollar losses in equipment and research.

The present invention is a system and method for automated rendezvous, docking, and capture of autonomous underwater vehicles at the conclusion of a mission. Specifically, the invention addresses the problem of automated recovery in extreme environments where simple vehicle egress to an open water surface followed by either transponder or satellite phone uplink of vehicle coordinates is impossible. Such environments include, but are not limited to: under ice operations where access is through a single drilled or melted access shaft; mapping of flooded mines wherein access is via a drilled shaft; mapping of subterranean water aqueducts where recovery must occur at a service access shaft; and, as well, deep sea operations where vertical transit is more efficiently accomplished by using a vessel operated riser line than through powered ascent by the vehicle.

BRIEF SUMMARY OF THE INVENTION

The present invention is an automated rendezvous and docking (ARD) system comprised of two primary components: a specially designed "docking rod" and an autonomous underwater vehicle that is designed explicitly to detect, approach, and latch to the docking rod. A lighted, pulsating (in both frequency and light intensity) series of LED light strips is on the docking rod, with the LEDs at a known spacing. The vehicle specially designed to detect and capture the rod and then be lifted structurally by a spherical end strop about which the vehicle can be pivoted and hoisted up (e.g., onto a ship).

Functional target capabilities of the AUV of the present invention include: nominal 10 kilometer penetration range under the ice shelf; operating maximum depth of 1 kilometer; building a high resolution up-look bathymetry map of the underside of the ice shelf along the exploration track; acquiring line bathymetry at the bottom of the Ross Sea under the ice shelf; collecting sonde cast equivalent data at one kilometer spacing; conducting proximity operations in contact with the ice shelf every kilometer (including the primary astrobiology protein fluorescence measurements into the ice, collecting water samples (three at each proxops location), and high resolution images); ability to track the vehicle on the surface during a mission (using through-ice localization systems); ability to communicate with the vehicle at high bandwidth via a vehicle-deployed data fiber; and ability to communicate with the vehicle at very low bandwidth using a custom wireless transceiver.

The AUV may be deployed from a workshop/mission control center, such as one located on the sea ice in McMurdo Sound adjacent the ice barrier (the McMurdo Ice Shelf locality of the Ross Ice Shelf), to explore, map, and conduct astrobiology science under the ice cap. The AUV of the present invention has a length of 4.34 m, width of 1.15 m, a height of 0.80 m, and weighs 950 kg. However, it is contemplated that large variances of these dimensions can be made and still be within the scope of the invention.

The present invention uses a pair of custom designed, very high efficiency primary thrusters (Prime Movers) to propel the vehicle to at least 1.3 m/s forward velocity, with an anticipated minimum ground track speed of 1 m/s in the worst-case-scenario of measured McMurdo sound currents. Early analyses of off-shelf thrusters in the force capacity region needed for the present invention showed mechanical coupling efficiency (stored electrical capacity to physical coupled force to the water column) of under 30%. The present invention achieves greater than 50% efficiency, which directly scales to a range increase of almost 70% which is ideal given the extraordinary opportunity for original exploration under the Ice Shelf.

Given the required depth rating and the need for heat dumping from the motor, the AUV of the present invention has an oil-filled design. The present invention further includes a magnetic coupling system and a PEEK end plate. The motors of the AUV of the present invention are unique in oceanographic design: they use dual independent motor windings, dual brushless controllers, and are cross routed to parallel independent batteries, making the vehicle truly redundant in propulsion. The vehicle can return home with the loss of a motor winding, a motor controller, and either battery failing for each of the Prime Movers. Further, redundant YAW thrusters assure that the vehicle can maintain heading even if one Prime Mover fails.

The docking system comprises a 2 m long rod with several novel features including a transparent outer shell which covers an oil-filled cavity containing 8 LED light strips oriented vertically at 45 degree spacing around the rod. An oscillating power supply may be used to drive the LED light strips at a specified frequency. The LED spacing is a uniform 1 cm and the lights can be made to oscillate as well as to selectively dim.

The central core of the rod is a structural member (a stainless rod) that can carry the full weight of the vehicle in air. The rod pivots by means of an upper gimbal so that any current that may cause sway in a supporting cable will not affect the rod remaining vertical. The bottom of the docking rod consists of a spherical anchor assembly that mates to a structural catch located in the nose of the vehicle. The bow of the vehicle contains a guide channel into which the docking rod glides, is mechanically captured, and then used to allow the vehicle to hang vertically from the end sphere during recovery up the access shaft.

After completing its mission objectives, the AUV of the present invention will dock with a specialized recovery apparatus under the ice. The purpose of the recovery apparatus is two-fold: First, to assist the vehicle with safe return through the ice borehole to the surface world, and second, to act as a safe "checkpoint" for the vehicle should unforeseen conditions render immediate recovery impossible (i.e., a location where the vehicle can "anchor" and stay in a known fixed location for later recovery, instead of drifting with the currents).

The recovery system consists of a 2-m-long structural rod with a large ball hitch on the end, fitted with lights flashing at a known frequency, and attached to the surface through the borehole with a strong tether. The AUV will capture the docking rod inside a Y-shaped slot anywhere along its length, then move down the rod until the ball hitch is captured in a hemispherical cavity inside the nose of the vehicle. Capture is acknowledged either by data fiber or RF data link. Once capture is acknowledged, the surface or suspension cable supporting the docking rod and docking rod are retrieved to within a few meters of the access hole. At that point, the vehicle will rotate to vertical pitch, and the operators will reel in the rod using the tether, dragging the vehicle up through the borehole with it. Once on the surface, lifting straps will be attached to separate hard points by human operators, and the vehicle will be lifted out of the water. In one embodiment, a 10 m length of 1.22 m diameter liner tube is extended through the sea ice to prevent brash ice from clogging the hole. This method of egress may require a centering device to allow the vehicle to enter the hole.

The AUV uses multiple stage homing system to locate the docking and recovery apparatus after the completion of a mission. First, the vehicle will use inertial navigation to get within 1 km of the borehole. Next, it will use the iUSBL to search for an acoustic signal coming from the beacon mounted on the fiber spooler just above the docking rod, move downstream of the target (to mitigate any tether tangling issues) and home to within 100 m of the target. Finally, a visual homing system using computer vision on the video stream coming from a camera mounted directly behind the Y-shaped docking slot will detect the flashing lights on the docking rod, and guide the vehicle through the final approach through the capture of the docking rod. All stages of the homing system have significant overlap in their operational ranges to build in flexibility and redundancy should any one stage fail.

The computer vision homing algorithm consists of three stages: a gatekeeper stage, a search stage, and a docking stage. The gatekeeper stage will be activated as soon as the vehicle decides to return home. This stage will simply monitor the vehicle's field of view for a flashing signal with the same frequency as the docking target so the vehicle knows when it is in the general vicinity of the target without much computational expense.

Once the gatekeeper has picked up the target signal, it will trigger the initial vision approach. The initial approach consists of hundreds of "searcher particles," which scour the camera image for the docking target based on heuristics such as intensity, flashing frequency matched to target frequency, and others. Using the locations of the searcher particles, the algorithm will build a probability map of the location of the docking target in the camera frame, and attempt to keep the highest probability location in the center of the camera image while driving forward.

When the search stage has brought the vehicle to within close range of the docking target, it will hand over control to the final approach stage. During final approach, the vision system will identify the individual LED lights on the docking bar, fit a line through them to get the orientation of the bar with respect to the camera, and measure the distance between LEDs to estimate the range to the target. This information will be used to align the docking rod with the Y-shaped slot through roll, then guide the vehicle to gently capture the docking rod in the slot. Capture is signaled by a gate Hall sensor which then triggers a servo-driven pin to close the gate. Mission Control is then notified of capture and the vehicle can be retrieved through a positive Z translation to the access shaft. Parallel access shafts, located 10 m apart, will allow for diver intervention at this stage should any issues arise preventing the vehicle from entering the access tube.

The present invention employs a distributed process architecture with networked publish-subscribe communications between processes using the Lightweight Communications and Marshalling (LCM) library. This architecture allows processing to be distributed between the multiple AUV and mission control processors in a flexible, transparent manner. In addition, all inter-process communications are logged and available for viewing in real time from mission control whenever the vehicle is connected to the network. The vehicle processes can be grouped into navigation sensing and estimation, position and attitude control, science operations, mission control user interface, and supervisory executive control and monitoring.

Vehicle control is split into three primary high-level vehicle controllers: open-water cruise and stand-off ceiling following, science tower contact scanning, and visual homing to the docking bar. The system executive determines which controller is active at any time based on the vehicle state and current task. The inputs to each of these modes are application-specific. Open water cruise uses the vehicle dead-reckoned navigation solution based on the Honeywell IRU, up- and down-look RDI DVLs, and Paroscientific depth sensors to perform waypoint following and similar open-water maneuvers. In ceiling-following, this controller is augmented so that vehicle depth is controlled to a fixed stand-off based on the up-look DVL ranges. On return, the dead-reckoned position estimate is augmented with iUSBL position fixes to correct the accumulated drift in the dead-reckoned solution and allow the vehicle to precisely determine the dock location and maneuver to a down-current position of it for final docking approach.

The science tower scanning mode, on the other hand, uses the sonar and laser altimeters on the tower to maintain PFS contact with the ceiling. This mode also relies on the passive compliance built into the PFS mount to augment the active control of the vertical thrusters. The science tower standoff allows the up-look DVL to operate outside its minimum ranges, so that horizontal motion can be controlled by the dead-reckoned navigation solution.

The visual docking mode uses the forward-facing camera to determine bearing and range to the docking bar. The visual sensor process searches for the frequency and illumination signature of the blinking docking bar, and determines bearing and a rough range to the bar. The visual control uses this measurement to point the vehicle at the bar and thrust towards it, ensuring the bar enters the docking slot on the nose. Loss of visual lock triggers a "retreat and reacquire" behavior which is designed to avoid tether entanglement.

When the vehicle is connected to the fiber-optic tether, the Mission Control console allows operators to monitor and interact with the vehicle. This includes real-time situational awareness displays of sonar and visual data, system status indicators, as well as operator input interfaces via command line or joystick.

The System Executive implements a top-level state machine using the SMACH library. This state machine implements various operating modes, high-level behaviors such as proximity operations and docking sequences, and responds appropriately to identified system faults. The Health Monitor module subscribes to system signals (e.g., battery level, CPU usage, navigation sensor readings) and raises faults when process heartbeats fail or non-nominal signal behavior is detected.

The three primary modes of operation in the System Executive are servo-level control, supervised autonomy, and full autonomy. The servo-level control mode gives the operator joystick control of the vehicle via the fiber tether. Under supervised autonomy, the operator is able to enter task-level commands or full task plans, monitor their execution, and adjust tasking according to circumstances, again using the fiber-optic comms. Under full autonomous mode, the vehicle performs a task plan, and handles exceptions and faults independently.

As part of the effort to enhance vehicle survival during under ice missions, there is an alternative method of communications with the vehicle that does not involve the use of a fiber optic data tether. Although the vehicle carries a 15,000 meter fiber spooler, there are situations where the fiber may have to be jettisoned (e.g., current carries the trailed fiber into an entanglement with frazil ice) and the vehicle includes a fiber cutter for that purpose that is triggered by a software decision process. However, because the vehicle dead reckoning navigation system (like all such systems) is subject to drift over time, the possibility exists that it could think that it was in the vicinity of the ARD recovery docking system when in fact it was significantly off course after a 12-hour mission.

To address this scenario, the present invention incorporated a low bandwidth RF communication system in which the vehicle trails an 18 m shielded antenna that will float up in contact with the ice and transmit the signal through the fresh ice to a receiver located at Mission Control. At a distance of more than 5 kilometers, the received signal was more than 10 db higher than theoretically predicted, suggesting communication capabilities with the vehicle at distances of up to 40 kilometers at 100 bits/s data rates—sufficient to upload true vehicle position and emergency egress target coordinates.

The present invention has application in commercial autonomous underwater vehicles world (for mapping, inspection, intervention, etc. . . . ) as it allows for very routine and reliable automated recovery of an unmanned underwater asset.

DETAILED DESCRIPTION OF THE INVENTION

Figure 1:
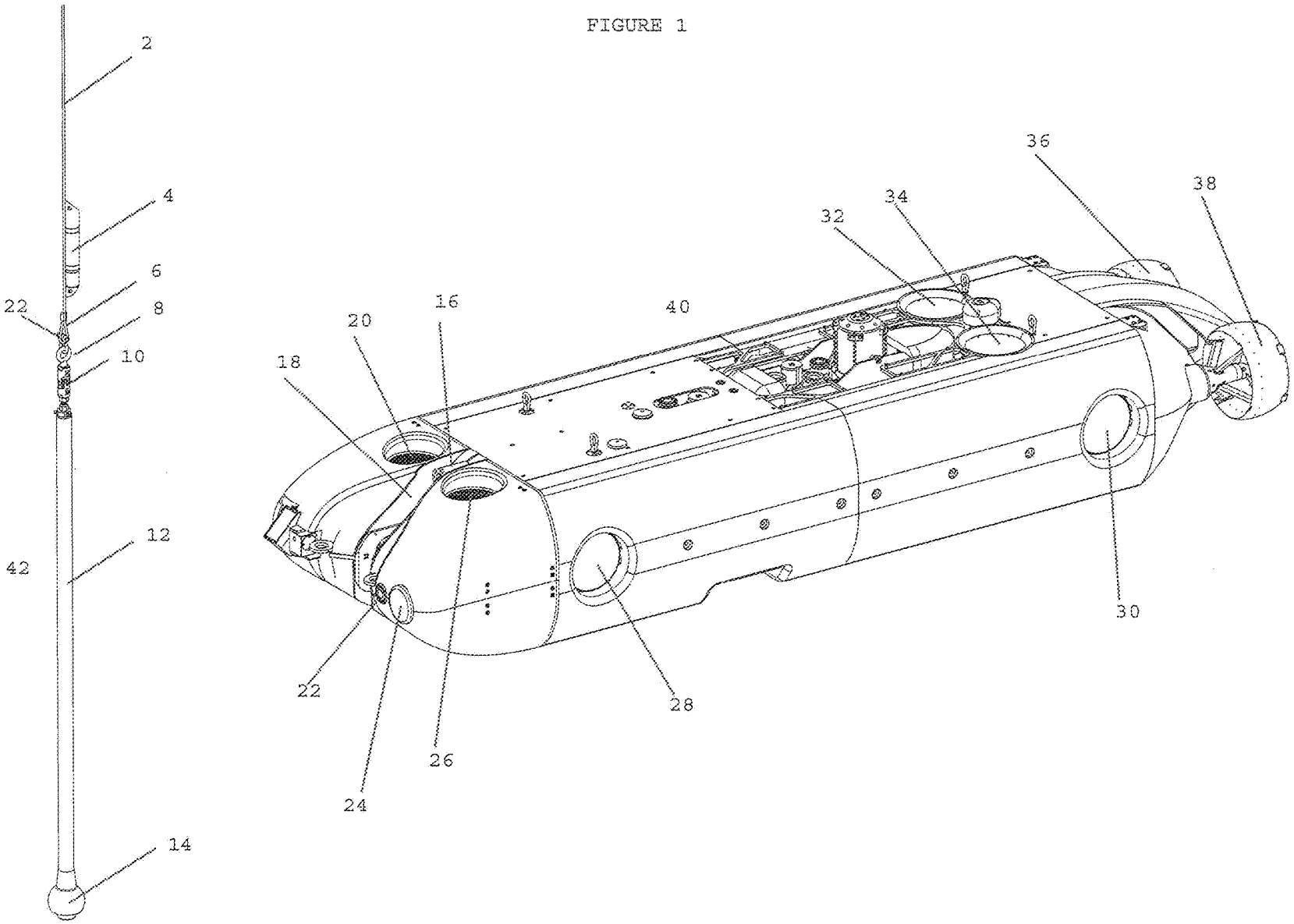
FIG. 1 is a side perspective view of an embodiment of the present invention.

FIG. 1 depicts the two primary components of the present invention. A specially designed docking rod 42 and an autonomous underwater vehicle 40 designed explicitly to detect, approach, and latch to the docking rod are shown. AUV 40 is shown approaching docking rod 42.

Advantageously, AUV 40 contains an onboard dead-reckoning navigation system (not shown) and a series of primary thrusters 36, 38 and attitude control thrusters 32, 34, 30, 20, 26, 28 that permit the vehicle to be precisely controlled in six degrees of freedom such that AUV 40 can hover (station keep), translate about any axis, and rotate about any axis. In an embodiment of the invention, primary thrusters 36 and 38 are able to efficiently move the vehicle forward (or in reverse) and can also, through differential thrust, cause the vehicle to rotate about the yaw axis. Attitude control thrusters 28 and 30 are able to laterally translate the vehicle as well as to rotate the vehicle independently about the yaw axis. Attitude control thrusters 20, 26, 32, and 34 are able to pitch or roll the vehicle as well as impart vertical translations to the vehicle.

The vehicle is furthermore advantageously equipped with a mid-stage homing system consisting of an inverted ultra-short baseline (USBL) acoustic tracking system in which transponder 4 is located on the cable suspending docking rod 42 and the USBL transponder unit is located in AUV 40 (now shown) (not shown) such that the vehicle has access to range and heading information towards transponder 4, beginning at a location as far as one kilometer from the docking target. The USBL system serves as a mid-stage navigation system for bringing AUV 40 to a more advantageous location wherein AUV 40 can optically detect docking rod 42 via a plurality of onboard machine vision cameras 16 (of which only one can be seen). An underwater lighting system 22 may be used in an auxiliary fashion to assist camera 16 in the detection of docking rod 42 in the event of an electrical failure that precludes normal operation of docking rod 42 as will be described in detail below.

The docking rod 42 portion of the system includes suspension cable 2, USBL transponder 4, cable end connector 6, shackle 22, screw eye 8, and universal joint connector 10 which suspend docking rod 42. The exterior of docking rod 42 is comprised of a translucent or transparent tube 12 made of a tough engineering material, such as polycarbonate plastic or the like. The bottom of docking rod 42 is comprised of a sphere or spherical segment which is significantly enlarged in diameter over that of the rod external tube 12.

Figure 2:
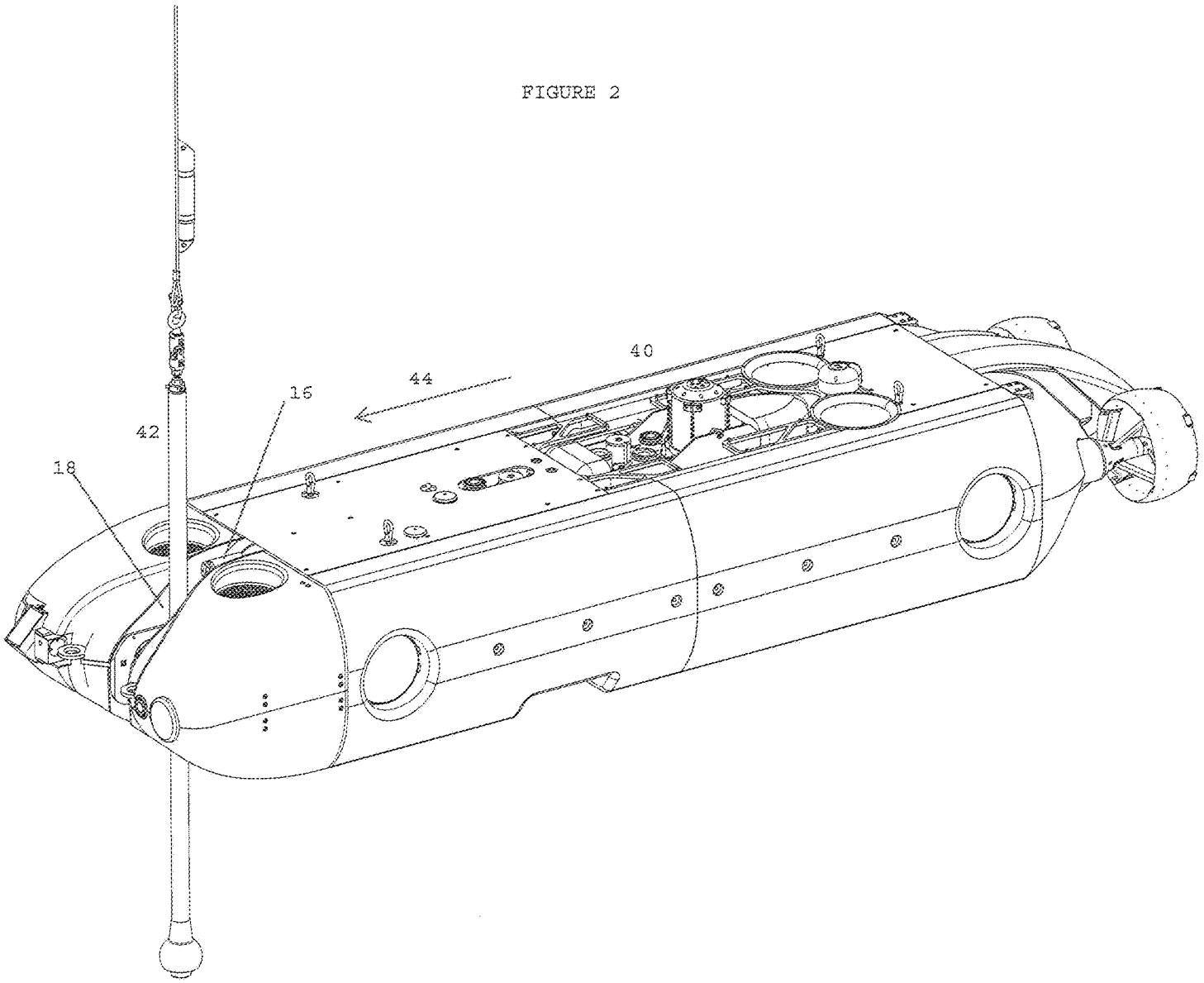
FIG. 2 is a side perspective view of an embodiment of the present invention showing the autonomous underwater vehicle engaged with the docking rod.

Now with reference to FIG. 2, the second stage in the auto docking sequence is shown. In this stage, AUV 40 moves forward along direction 44 towards docking rod 42, using machine vision camera 16 for guidance, until the docking channel 18 in the front of AUV 40 captures docking rod 42 at about its midpoint employing a capture mechanism that will be described in greater detail below.

Figure 3:
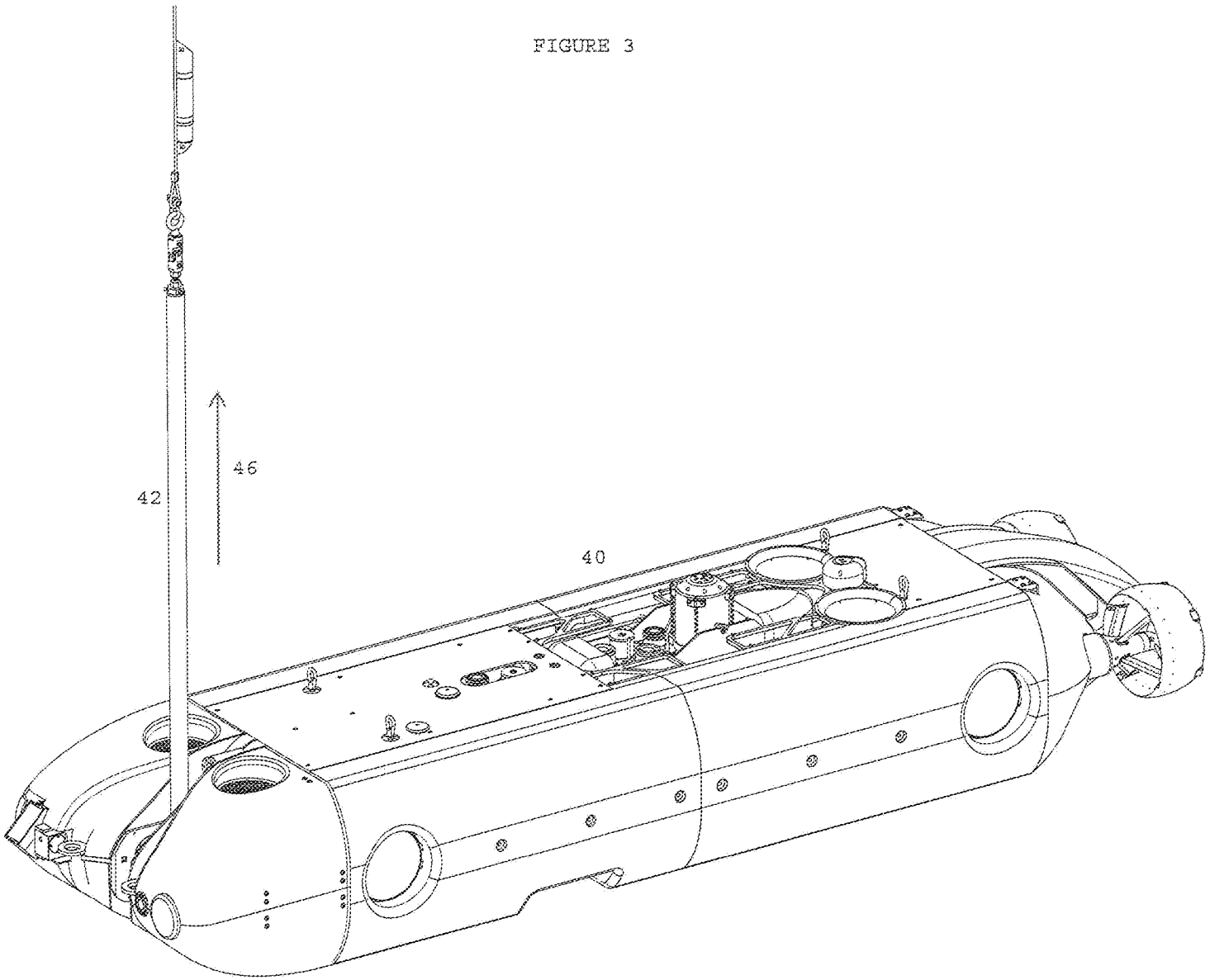
FIG. 3 shows a side perspective view of the autonomous underwater vehicle engaged with the docking rod of the present invention.

FIG. 3 shows the third stage in the auto docking sequence. The docking rod 42 is raised in direction 46 until the spherical bottom 14 of docking rod 42 engages a special spherical structural receptacle (not shown) inside docking channel 18. Alternatively, AUV 40 may thrust vertically downward to achieve the same effect. At this point it is possible for surface-operated equipment to hoist docking rod 42 (and AUV 40) to the surface or near to the surface.

Figure 4:
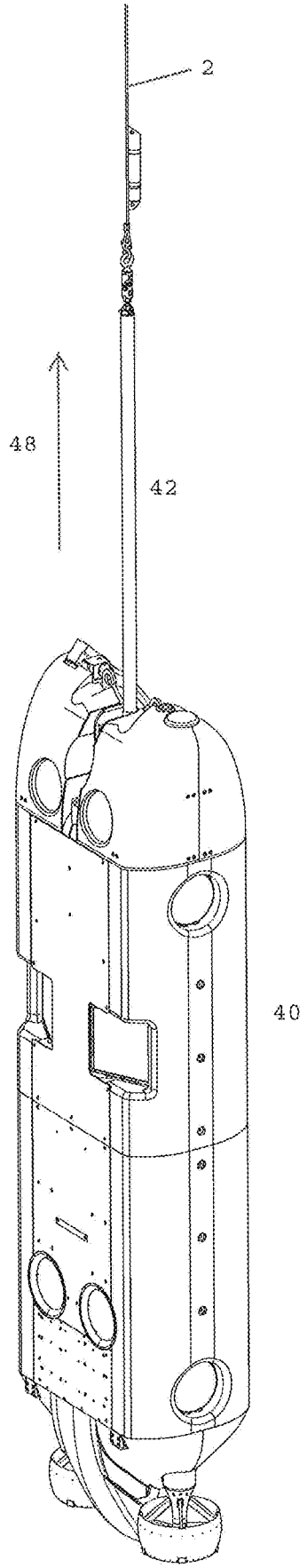
FIG. 4 shows a side perspective view of the engaged autonomous underwater vehicle in vertical alignment with the docking rod of the present invention.

Referring now to FIG. 4, the final stage in the auto docking and recovery sequence is shown. AUV 40—capable of 6 degrees of freedom of motion and rotation, as previously described—undergoes a 90-degree pitch up maneuver executed by rotating the vehicle stern downward using a combination of vertical attitude control thrusters, e.g., 32, 34 (see FIG. 1), and the prime movers, i.e., 36, 38 (FIG. 1), until the vehicle achieves a vertical attitude with the nose up and attached to docking rod sphere 14. At this point, AUV 40 may be lifted by docking bar 42 in direction 48 and either up out of the water or through a vertical access shaft that leads from the water to an operations base or surface vessel.

Figure 5:
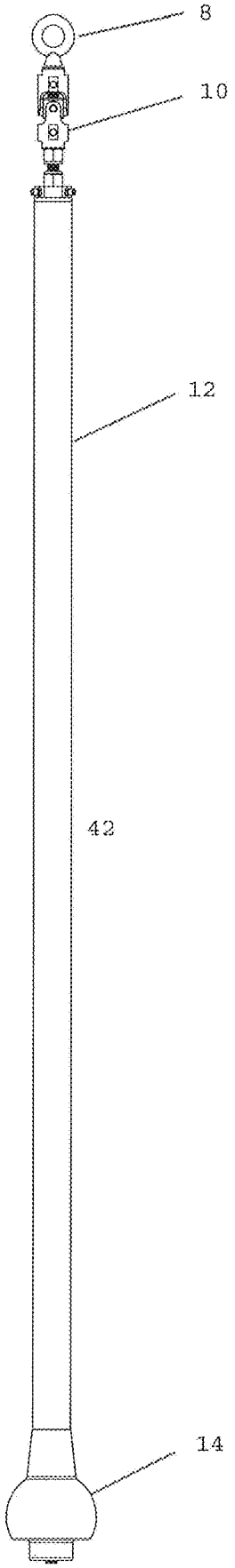
FIG. 5 shows the docking rod of the present invention.

Turning now to FIG. 5, a simplified exterior view of docking rod system 42 is shown. Docking rod system 42 is generally suspended in the water column by a cable (see FIG. 4) to a surface tender (ship or other fixed infrastructure) that is mechanically connected to load eye 8 which is connected to a universal joint capable of sustaining axial load capacity to hold the weight of both docking rod 42 and AUV 40. A central structural member (not shown) connects universal joint 10 to docking sphere 14 through the center of docking rod 42. The exterior surface of docking rod 42 is comprised of a continuous translucent or transparent hollow cylinder 12 made of a suitable engineering material, such as polycarbonate plastic or the like, capable of resisting hydrostatic pressure at the design operating depth of docking rod 42 (which can be full ocean depth of 11 kilometers if the interior of shell tube 12 is filled with an incompressible liquid such as oil).

Figure 6:
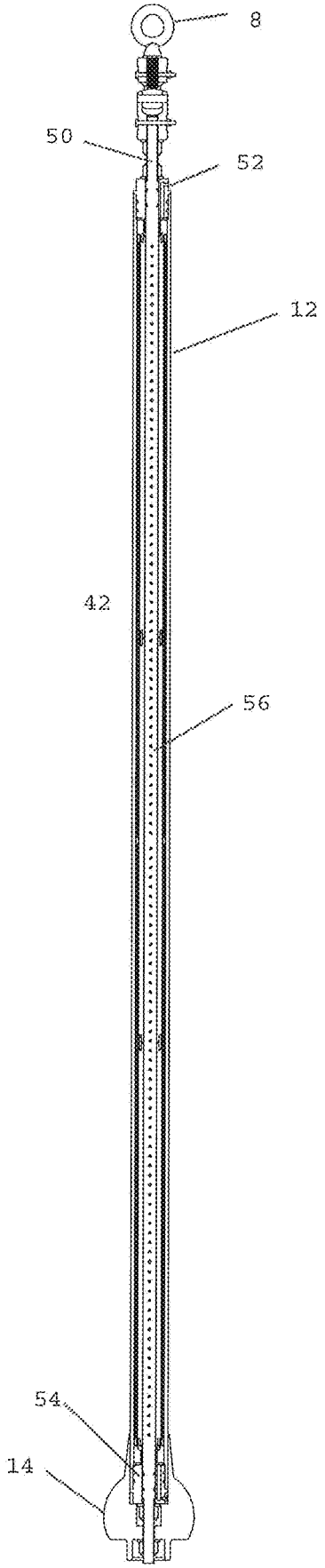
FIG. 6 shows a side cross sectional view of the docking rod of the present invention.

Turning now to FIG. 6, a section view of docking rod 42 is shown in which core structural rod 50 is visible. Structural rod 50 is sealed to external tube 12 through the use of two end caps 52 and 54 which utilize both internal and external O-ring sealing means to prevent ingress of water into the interior electronics compartment of docking rod 42.

Figure 7:
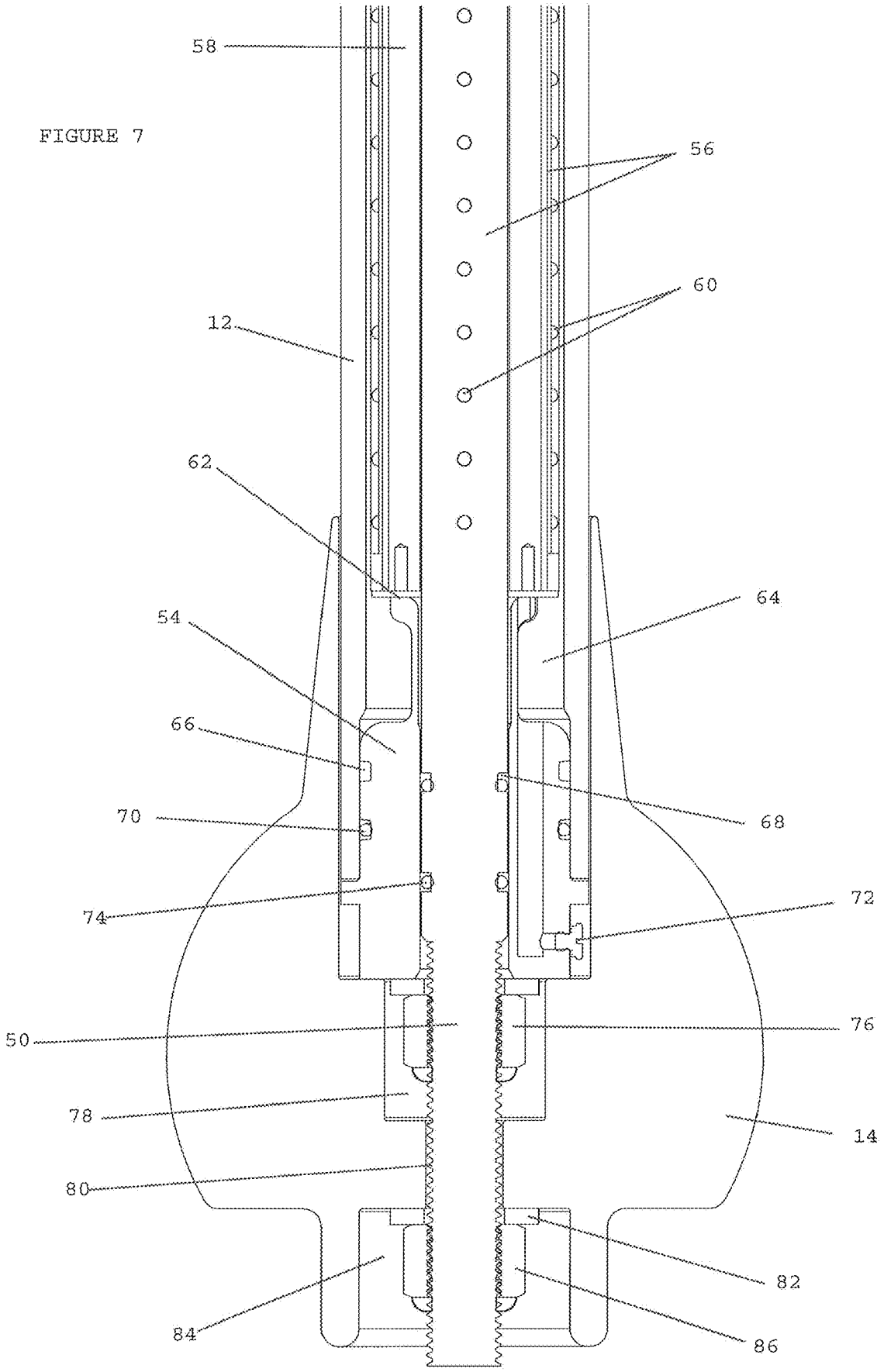
FIG. 7 is a side cross sectional view of the engaging portion of the docking rod of the present invention.

Referring now to FIG. 7, central rod 50 forms the structural backbone of docking rod 42. Central rod 50 is fabricated from a suitable engineering material capable of supporting the weight of docking rod 42 and AUV 40 in air in direct tension. In the central portion of docking rod 42, structural support rod 50 is surrounded by insulating annulus 58 which can be of engineering plastic (e.g., Delrin) machined or fabricated with a plurality of channels.

The plurality of channels carry strips 56 of a flexible printed circuitry system onto which are mounted LED lights 60 at a regular spacing. The frequency of LED lights 60 is preferentially in the blue-green spectrum which serves to reduce attenuation in water.

The LED strips are protected by external transparent shell 12. Insulating annulus 58 is supported by pedestal 62 which is an integral feature of end plug 54. End plug 54 may be fabricated of any suitably tough engineering material including either plastic or metal.

At the location of end plug 54, central structural rod 50 contains two O-ring grooves 68 into which fit O-rings 74 which seal end plug 54 with structural rod 50 and prevent entry of water into the interior of tube 12. Similarly, the exterior of end plug 54 contains two O-ring grooves 66 and O-rings 70 that serve to seal end plug 54 with exterior shell 12. The combination of these two sets of O-rings (inner and outer) prevents water from entering the electronics and LED cavity of the docking rod.

Still referring to FIG. 7, port plug 72 allows for oil filling of the interior of tube 12 to allow the system to be operated at full ocean depth. Structural rod 50 is anchored to end plug 54 by fastener means 76 which resides inside cavity 78 of capture sphere 14. A drilled hole 80 in capture sphere 14 allows capture sphere 14 to be attached to load rod 50 by fastener and washer means 86 and 82, respectively, which reside inside cavity 84 of capture sphere 14.

Figure 8:
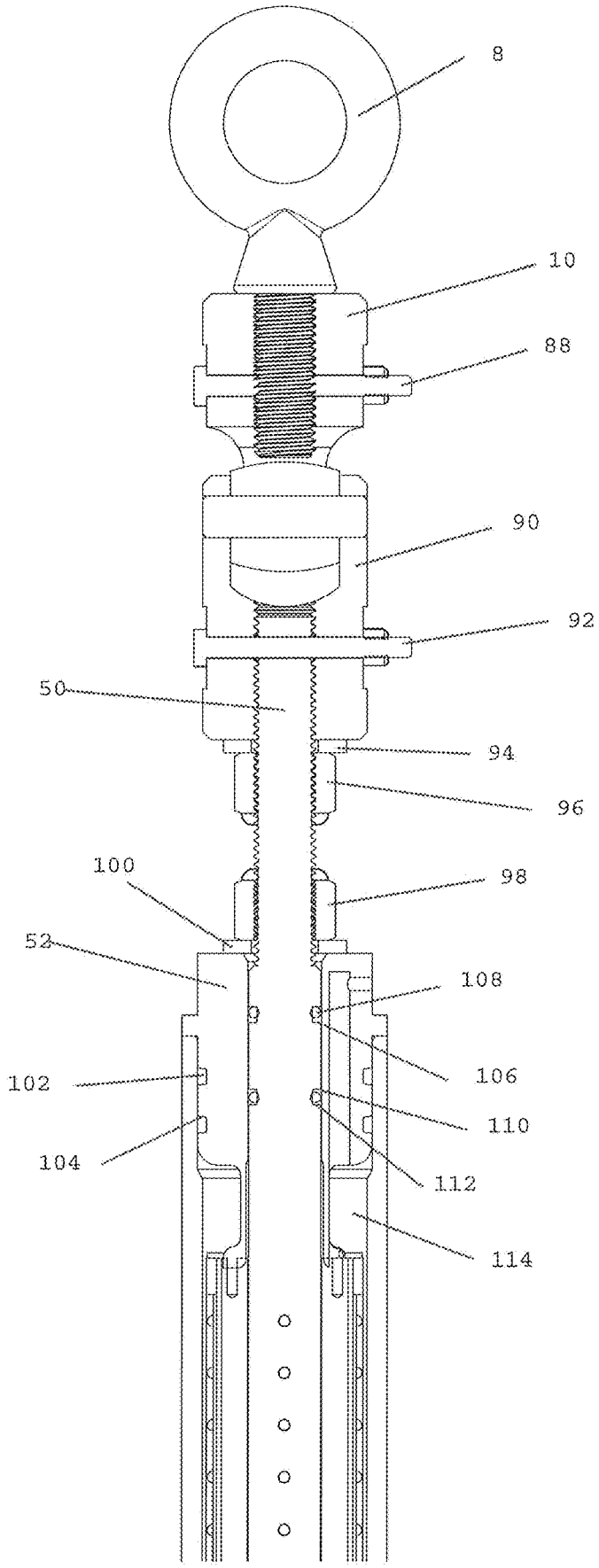
FIG. 8 is a side cross sectional view of the top of the docking rod of the present invention.

Now turning to FIG. 8, the interface between structural rod 50 and top end plug 52 is analogous to the lower capture sphere 14. End plug 52 has two radial O-ring grooves 102, 104 and O-ring sealing means that seal end plug 52 to exterior tube 12. Structural rod 50 contains two radial O-ring grooves 106, 112 that contain O-ring sealing means 108, 110 that seal structural rod 50 to end plug 52. Radial cavity 114 serves to provide space for routing of electrical conductors to the LED strips. Docking rod 50 Structural rod 50 is anchored to end plug 52 by fastener and washer means 98 and 100. Similarly fastener and washer means 96 and 94 connect structural rod 50 to the bottom half 90 of universal joint 10. Retainer safety means 88 and 92 prevent structural rod 50 and eyebolt 8 from accidentally becoming detached from structural rod 50.

Figure 9:
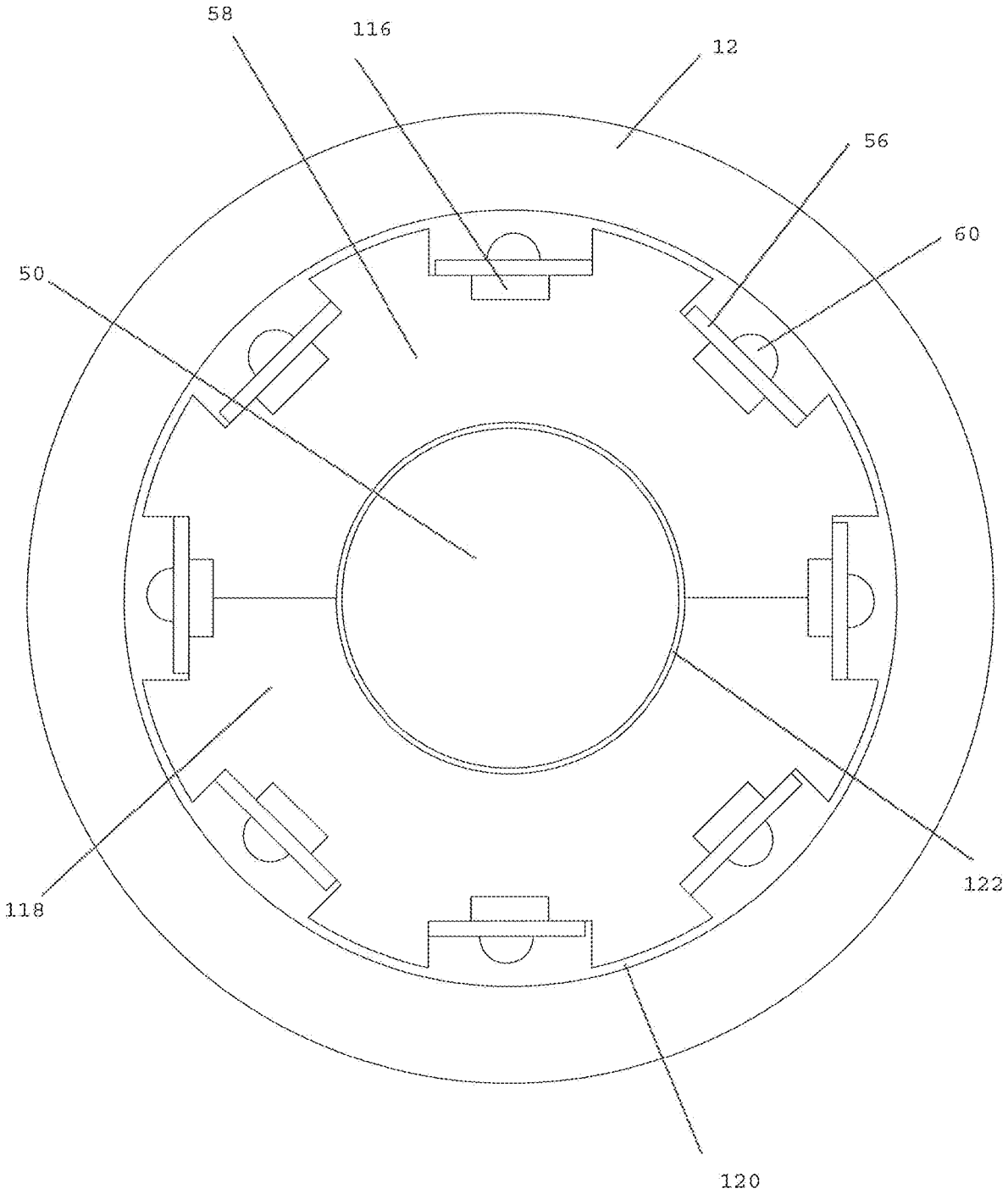
FIG. 9 is a cross sectional view of the docking rod of the present invention at mid height.

FIG. 9 shows a cross section of docking rod 42 at mid height. Structural rod 50 forms the core of the invention. Structural rod 50 is surrounded by a plurality of insulating annulus support elements 58, 118 for carrying the flexible printed electronic strips 56. Each electronic strips 56 carries a linear array of LEDs 60.

Insulating annulus support elements 58, 118 may advantageously carry a channel 116 beneath electronic strips 56 for carrying wires needed to power the LED lights. Although FIG. 9 shows two half annuli 58, 118, this could be fabricated as an extruded monolithic element or as additional segments. The main purpose is to insulate LED lighting strips 56 from the conducting central core rod 50.

Similarly, FIG. 9 shows 8 LED strips 56 being used at 45 degree angles. Others radial displacements may be used but in general, to ensure full 360-degree approach visibility, at least 4 and preferably 6 to 8 channels carrying LED strips will be used in the preferred embodiment of the invention. Gap 122 provides assembly clearance between structural rod 50 and insulators 58, 118. Gap 120 provides clearance between the outer radius of the insulating annuli and the inner face of transparent tube 12.

Figure 10:
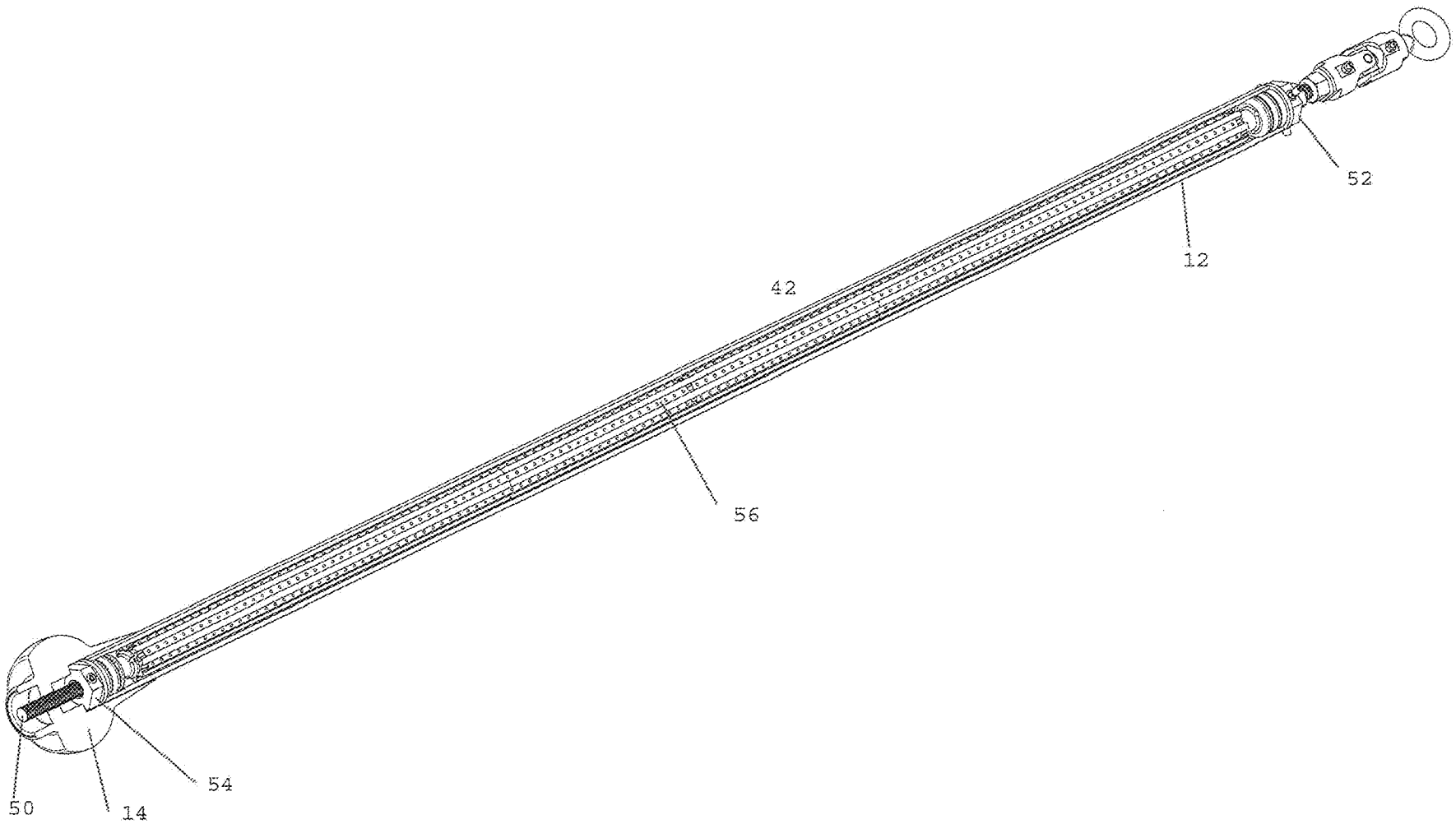
FIG. 10 is an isometric cross sectional view of the docking rod of the present invention.
Figure 11:
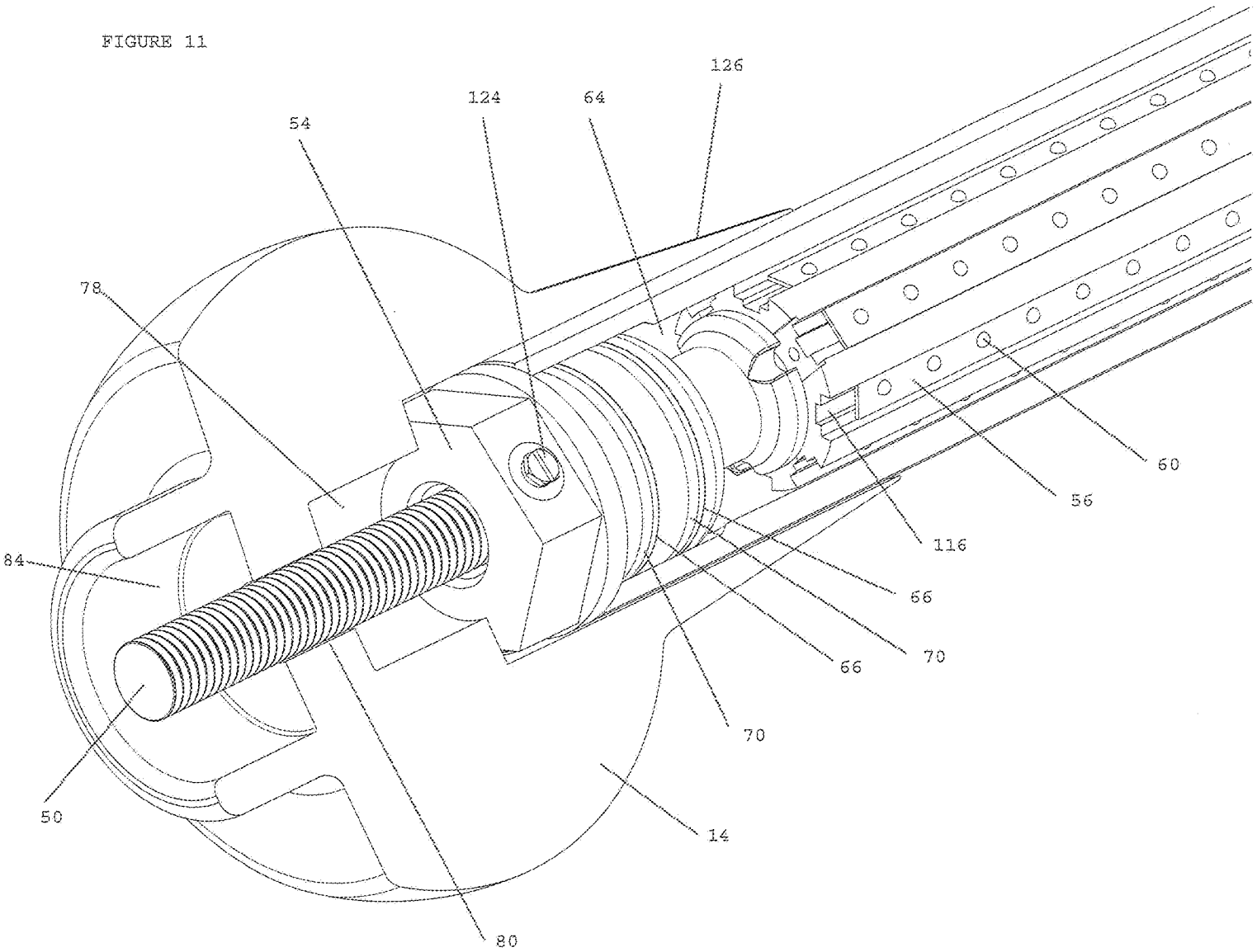
FIG. 11 is a cross sectional perspective view of the engaging portion of the docking rod of the present invention.

FIG. 10 shows an isometric, section view of docking rod system 42 with major features as previously identified. FIG. 11 provides a closer view of the bottom of docking rod system 42 (shown in FIG. 10) with major features as previously identified. Capture sphere 14 advantageously has a tapered transition 126 on its upper side to allow for smooth capture into the docking channel on the AUV.

Figure 12:
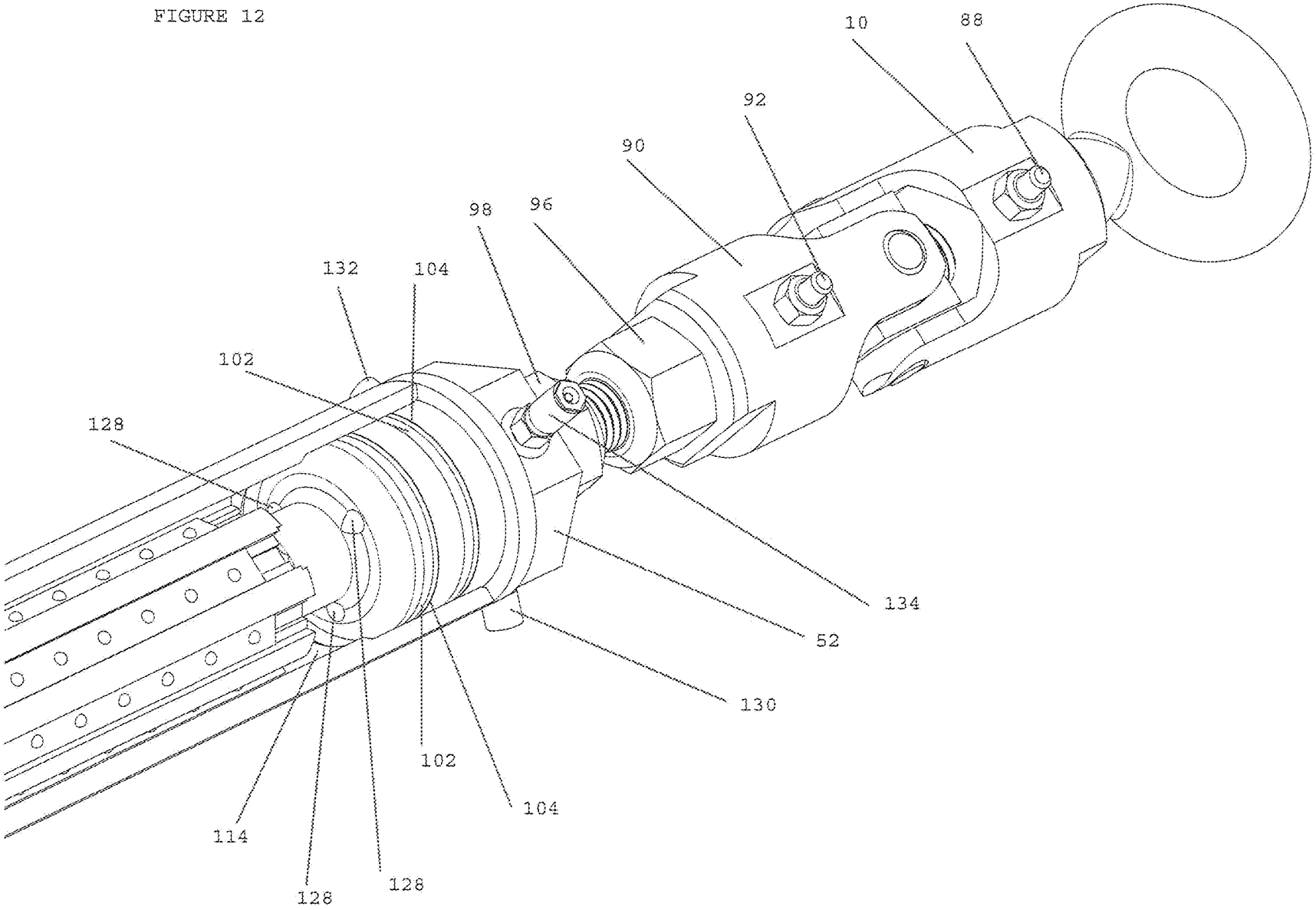
FIG. 12 is a cross sectional perspective view of the top of the docking rod of the present invention.

Turning now to FIG. 12, the bottom top of docking rod system 42 (with major features as previously identified) is shown. Top end plug 52 contains up to three umbilical elements: electrical power bulkhead penetrators 130 and 132 and an oil fill port 98 that can be used to fill the internal cavities with oil to allow for full ocean depth operations. Central longitudinal access holes 128 meet with right angle access holes from penetrators 130 and 132 and oil fill port 98 so that electrical wiring for powering the LED strips 56 can reach the central section of tube 12 and connect to LED strips 56 and for oil to fill the central cavity.

Figure 13:
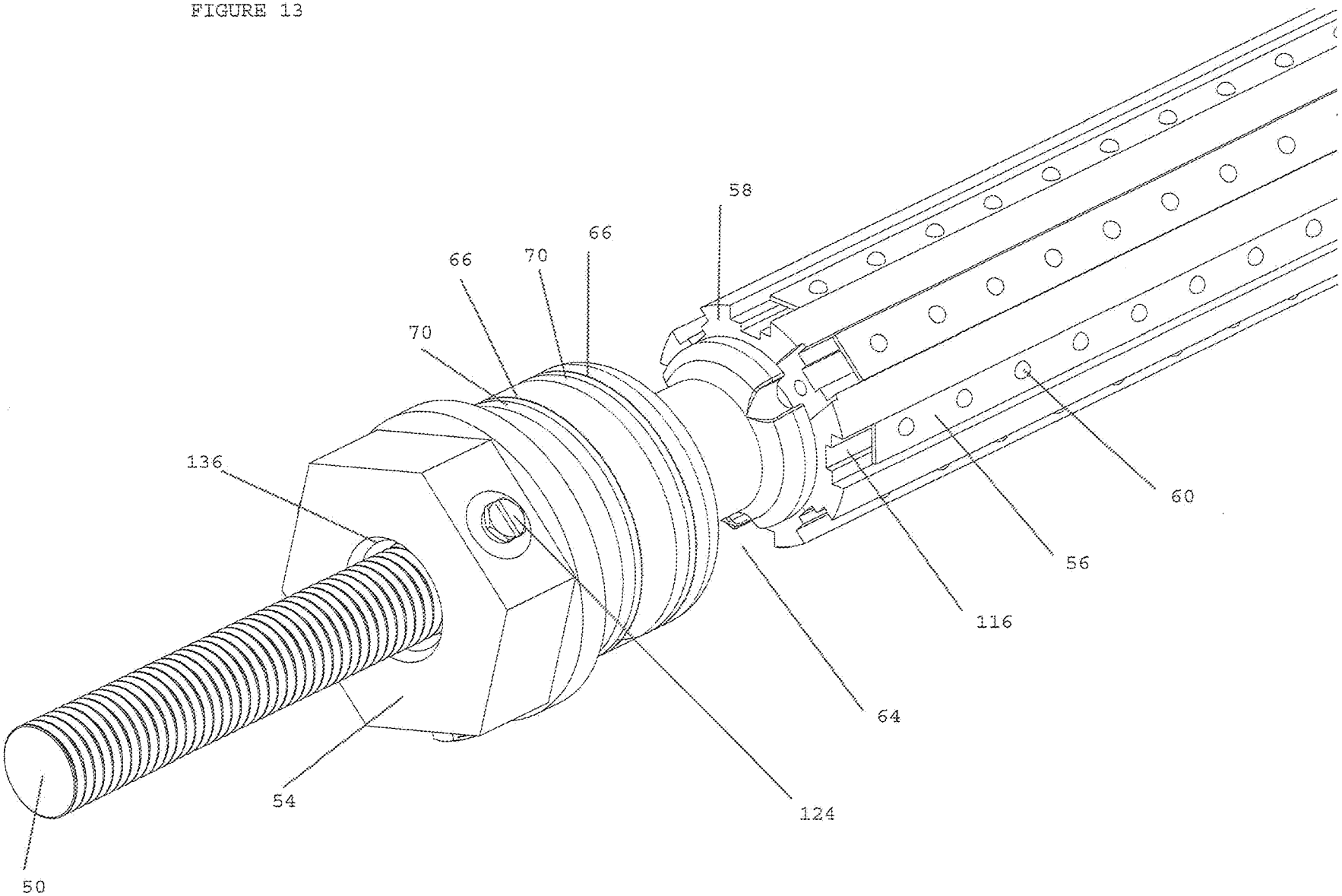
FIG. 13 is a cross sectional perspective view of the engaging portion of the docking rod of the present invention with reference to FIG. 11 with certain elements removed for clarity.
Figure 14:
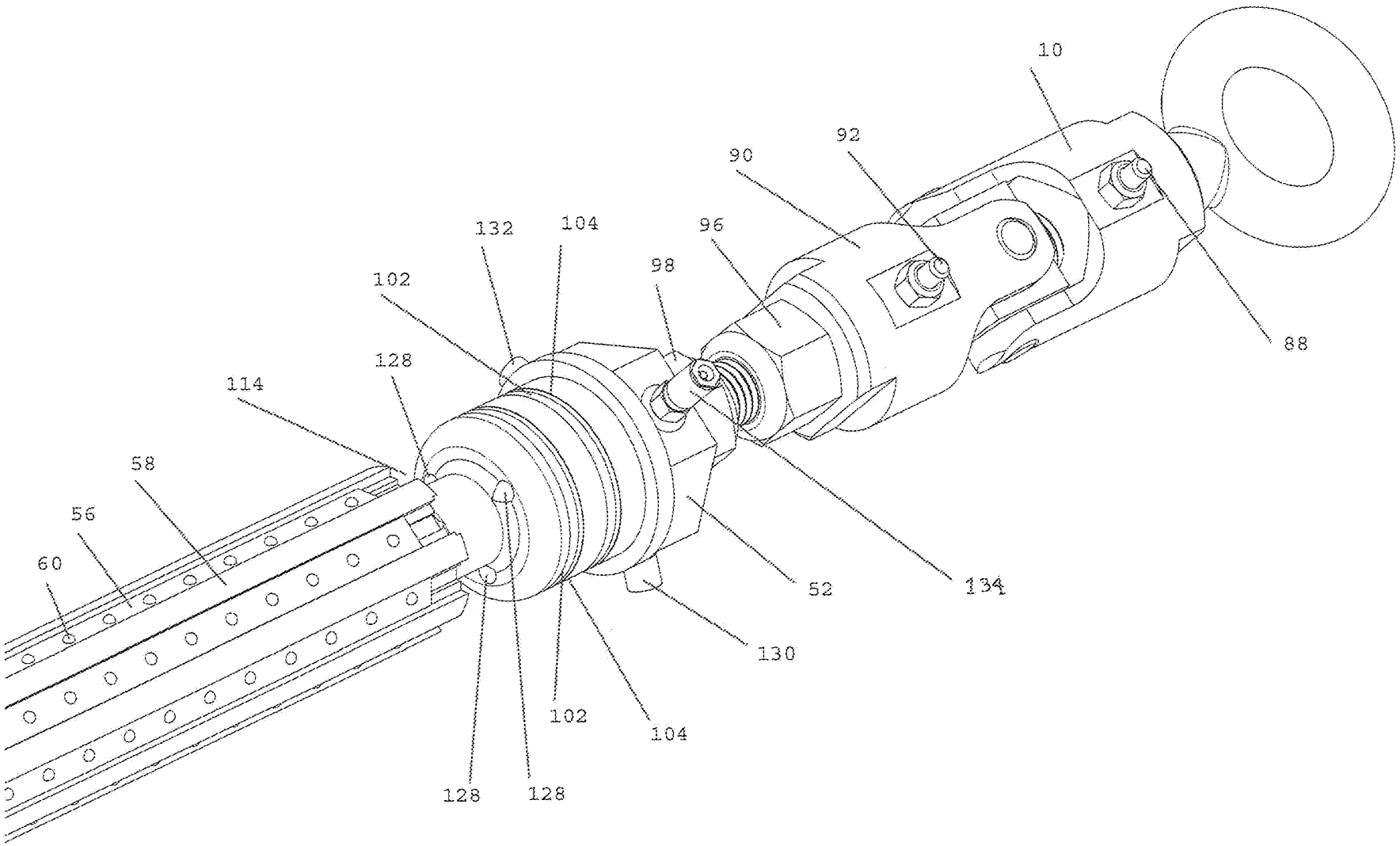
FIG. 14 is a cross sectional perspective view of the top of the docking rod of the present invention with reference to FIG. 12 with certain elements removed for clarity.

Referring now to FIG. 13, the bottom of docking rod system 42 is shown with both the capture sphere 14 and outer tube 12 (see FIG. 11) removed for further clarity. Major features are as previously identified. FIG. 14 shows an isometric, section view of the top of docking rod system 42 with the outer tube 12 (see FIG. 12) removed for further clarity. Major features are as previously identified.

Figure 15:
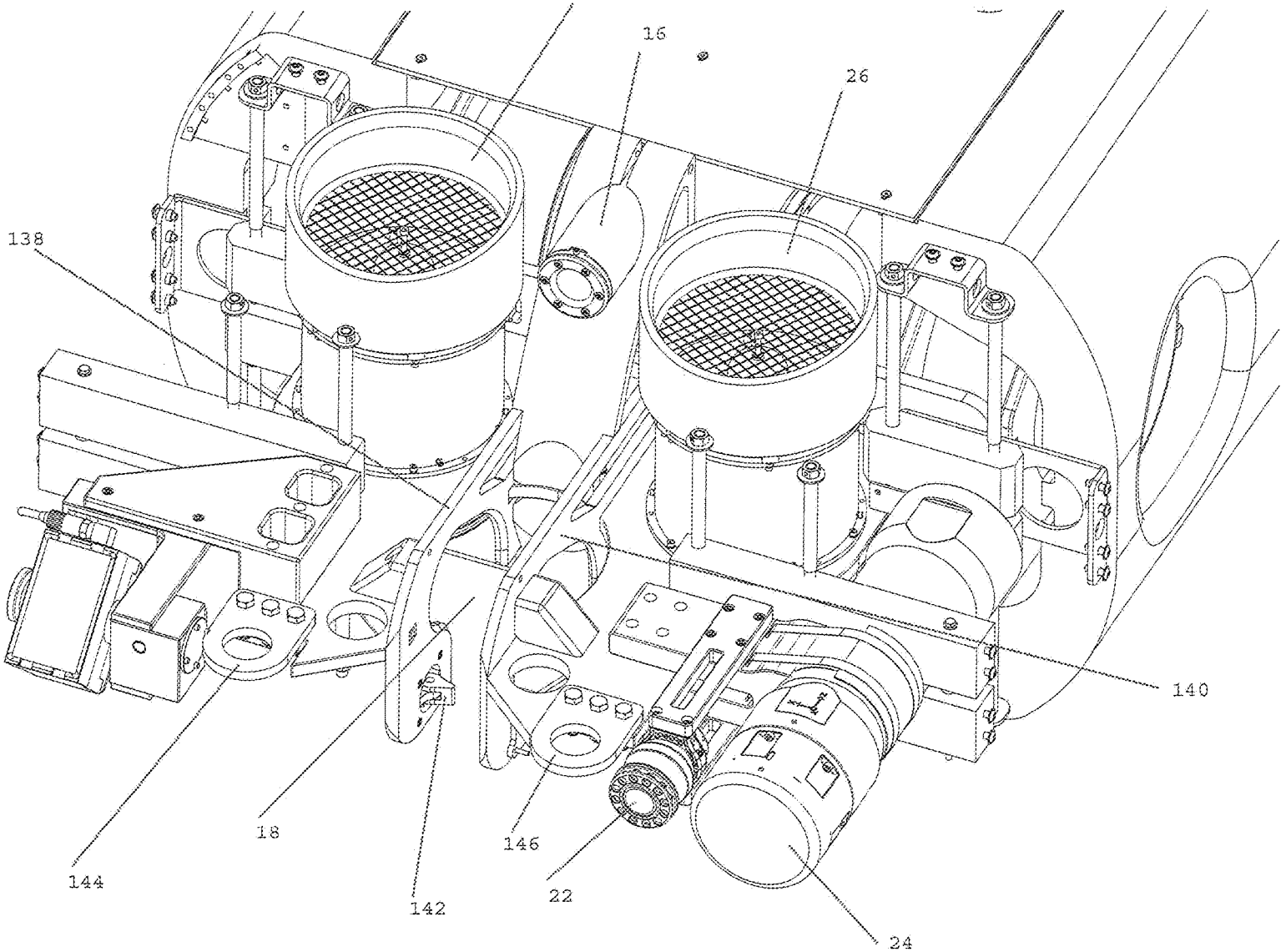
FIG. 15 is a perspective view of the front end of the autonomous underwater vehicle of the present invention with reference to FIG. 12 with certain elements removed for clarity.

Turning to FIG. 15, front end of AUV 40 is shown with some external skin and floatation elements removed for clarity. Elements not previously identified include channel structural elements 140 and 138 that define capture channel 18. Latch 142 is one of two latches that prevents docking rod 42 from escaping once captured. A mirror image latch 150 (see FIG. 16) forms a passive capture system. However, the same effect could be obtained using a servo-controlled active bolt capture system in which a detector that determines that the rod has been captured then signals an onboard computer to activate extension of a piston or servo-extended rod that achieves the same effect. Structural channel elements 138 and 140 are sufficiently strong that the capture sphere 14 (FIG. 5) can, in conjunction with these two elements, lift the AUV 40 vertically in air (see, e.g., FIG. 4). Alternate vehicle lift points 144 and 146 can be used to transfer the weight of AUV 40 to an auxiliary hoist system once the vehicle is out of the water.

Figure 16:
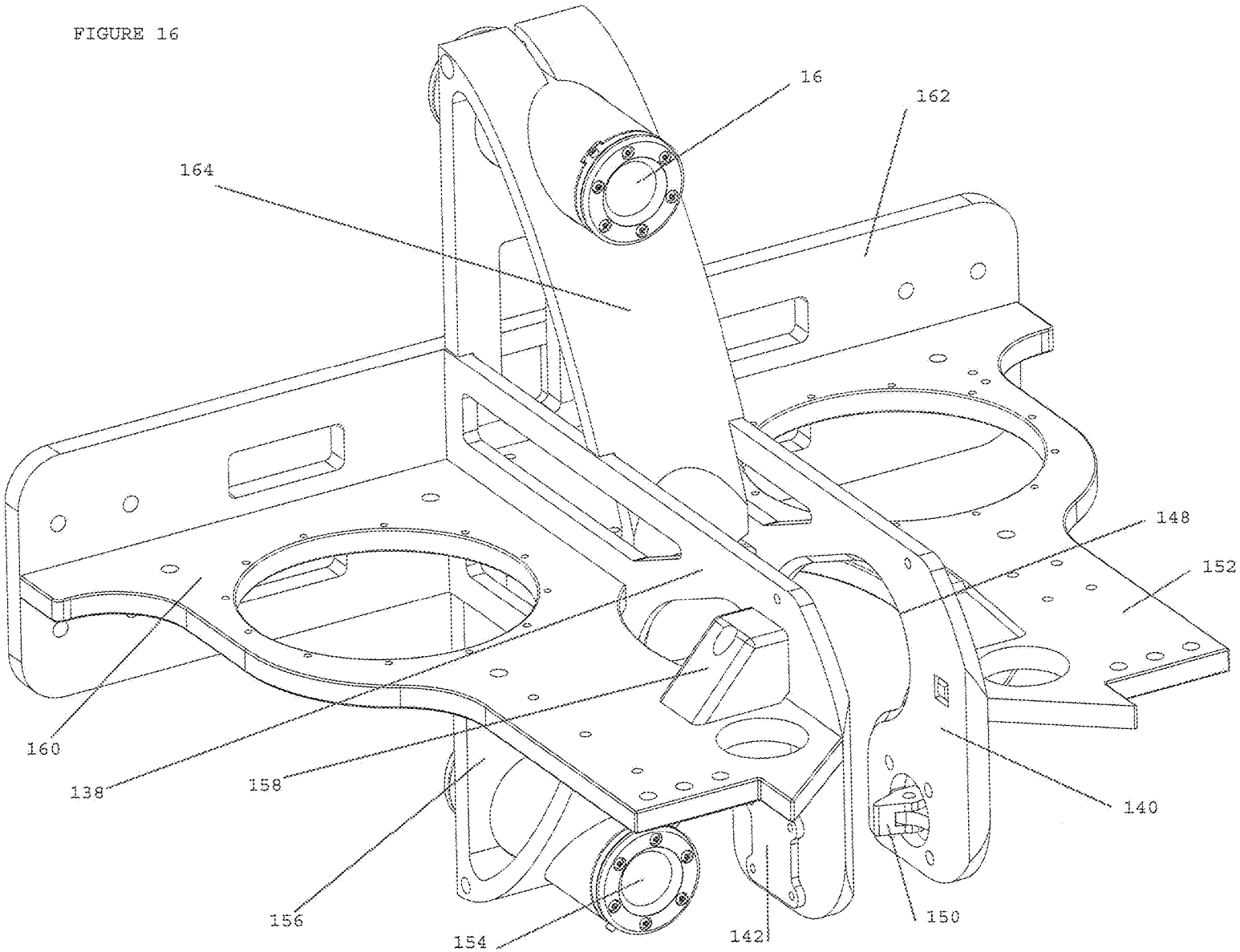
FIG. 16 is a perspective view of the front end of the autonomous underwater vehicle of the present invention with reference to FIG. 15 with certain elements removed for clarity.

Referring now to FIG. 16, the front end of AUV 40 is shown with all elements removed except the basic framing and elements essential to the auto docking system. As previously mentioned, a plurality of machine vision cameras 16, 154 may be used for optical recognition of lighted docking rod 42. The use of multiple cameras provides a redundancy advantage should one of the cameras not function properly or at all. Cameras 16 and 154 are held in place by support frames 164 and 156, respectively. The plurality of machine vision cameras 16, 154 has clear view of docking channel 18 and a forward field of view that permits clear, distant viewing of lighted docking rod 42.

Latches 142 and 150 are supported by docking channel structural elements 138 and 140. Elements 138 and 140 are supported and stiffened by stiffners 158 (of which only one can be seen) and horizontal load bearing structural elements 160 and 152. Elements 160 and 152 carry load back to bulkhead panel 162 which then can be connected to the main AUV structural backbone. The purpose of said structural elements is to transfer the entire weight of AUV 40 in air to a series of spherical cut-outs 148 in channel structural elements 138 and 140.

Figure 17:
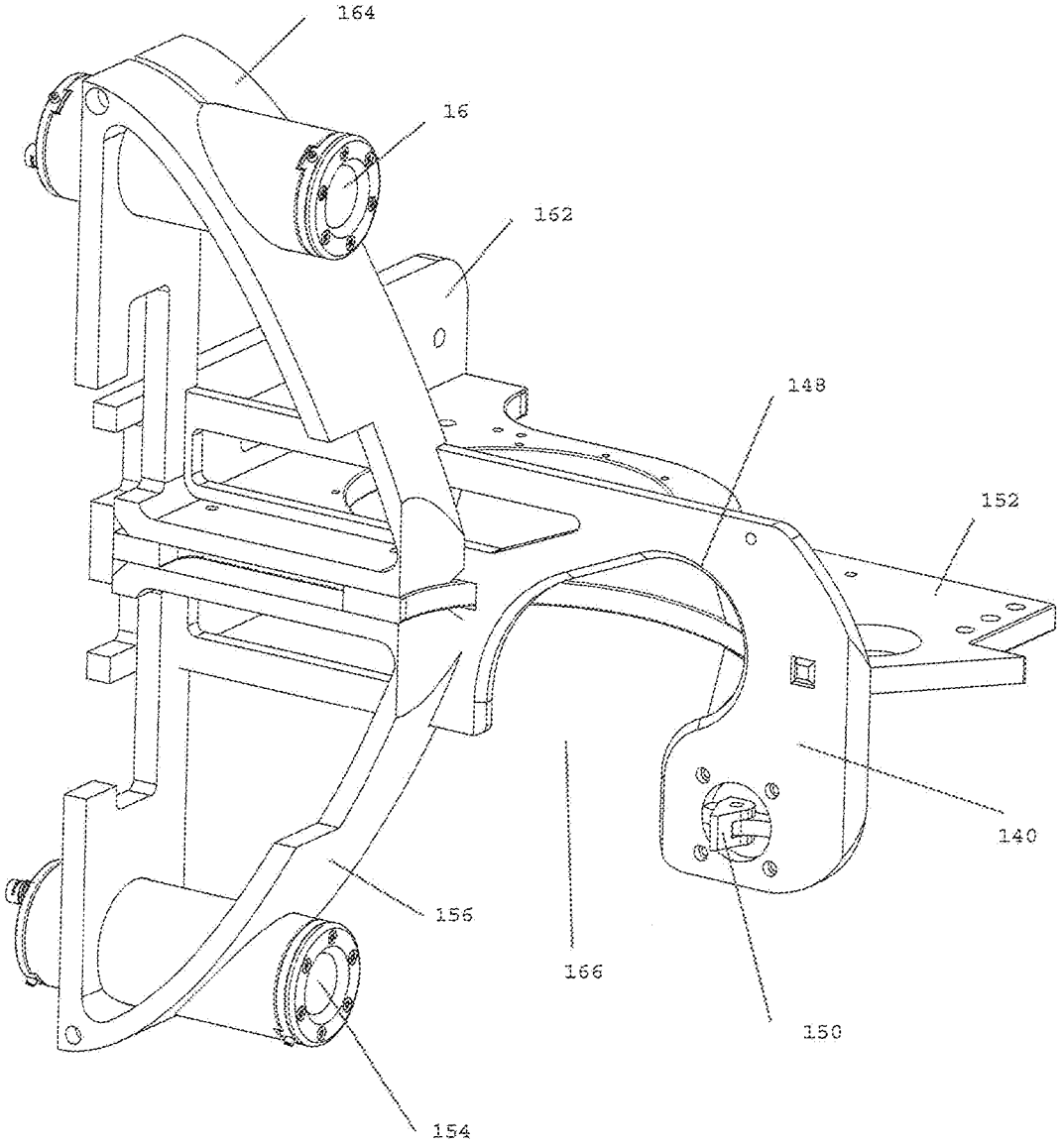
FIG. 17 is a perspective view of the front end of the autonomous underwater vehicle of the present invention with reference to FIG. 16 with certain elements removed for clarity.

FIG. 17 depicts a further cut-away view of the elements described in FIG. 16. Notably, there is a vertical transition channel 166 that allows capture sphere 14 to rise up and preferentially glide into and be further captured by spherical cavity 148 when docking rod 42 is raised, as shown previously in FIG. 3.

Figure 18:
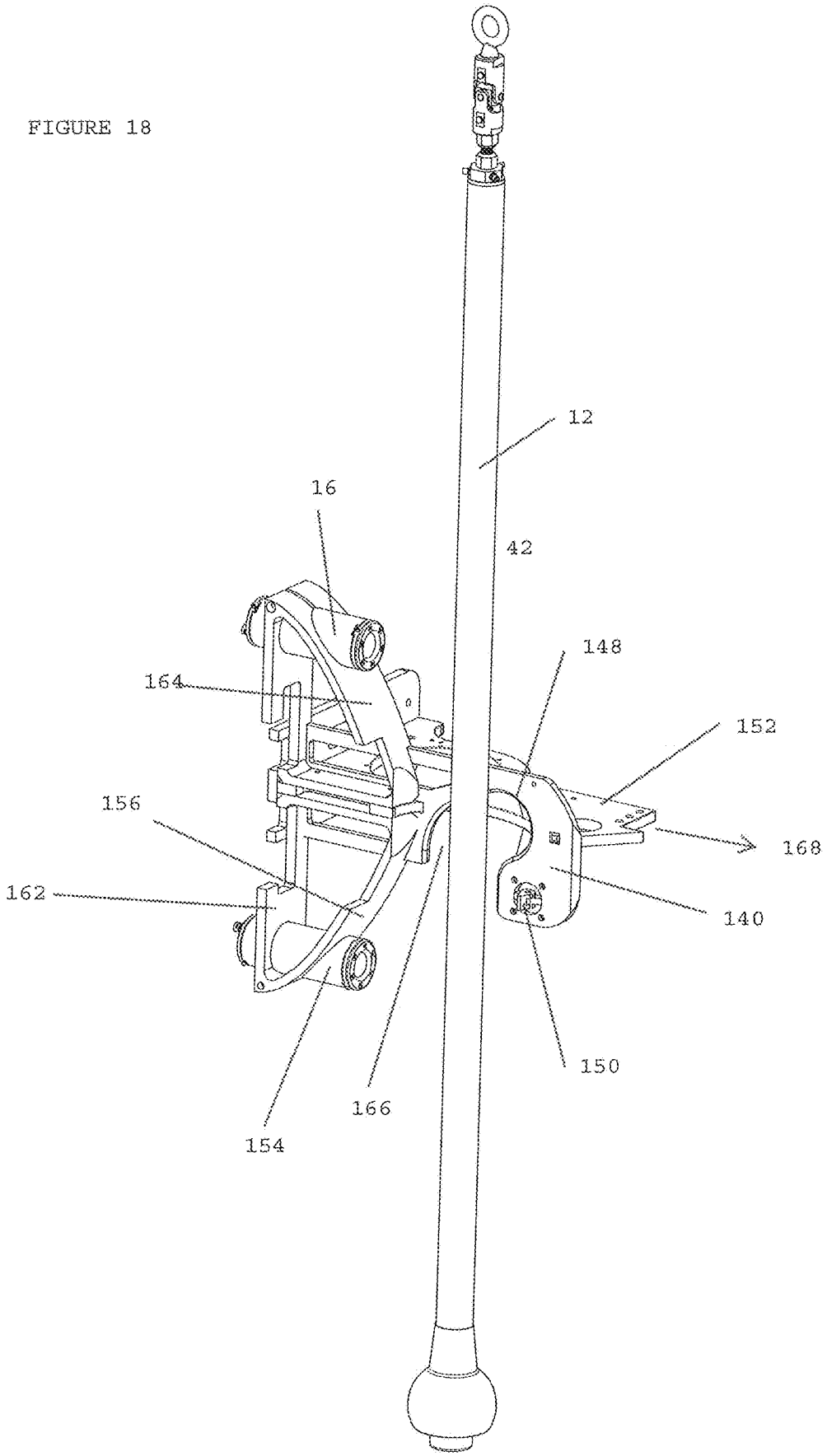
FIG. 18 is a perspective view of the front end of the autonomous underwater vehicle engaged with the docking rod of the present invention with reference to FIG. 2 with certain elements removed for clarity.

FIG. 18 shows a cutaway view of FIG. 2 (rotated 90° about docking rod 42) with only the essential interacting elements. All items are as previously described. AUV 40 is moving forward in direction 168. The configuration, as shown in FIG. 18, is that which exists immediately following initial capture of the docking rod by the AUV.

Figure 19:
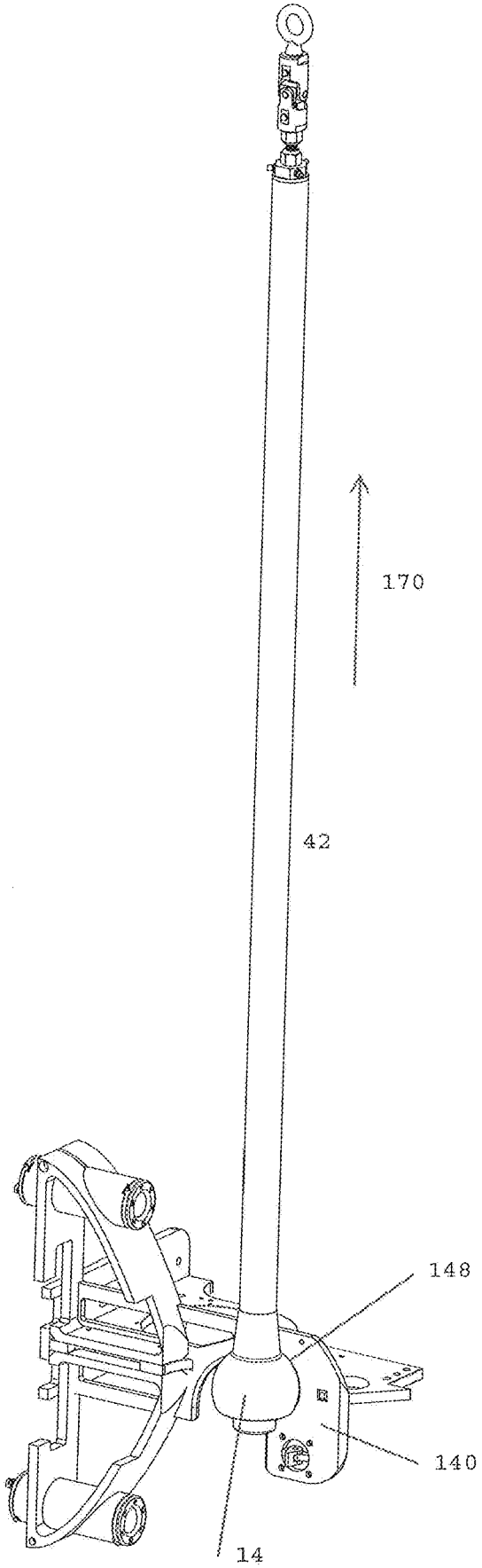
FIG. 19 is a perspective view of the front end of the autonomous underwater vehicle engaged with the docking rod of the present invention with reference to FIG. 3 with certain elements removed for clarity.

Turning to FIG. 19, a cutaway view of FIG. 3 (rotated 90° about docking rod 42) is shown with only the essential interacting elements. All items are as previously described. AUV 40 is captured and docking rod 42 is being raised in direction 170 until capture sphere 14 is captured by spherical cavity 148. Alternatively, AUV 40 may thrust downward to achieve the same effect. In this configuration, docking rod 42 may be raised to the surface by a surface vessel or other fixed or mobile facility until such time as the vehicle is close to the initiation of an access shaft.

Figure 20:
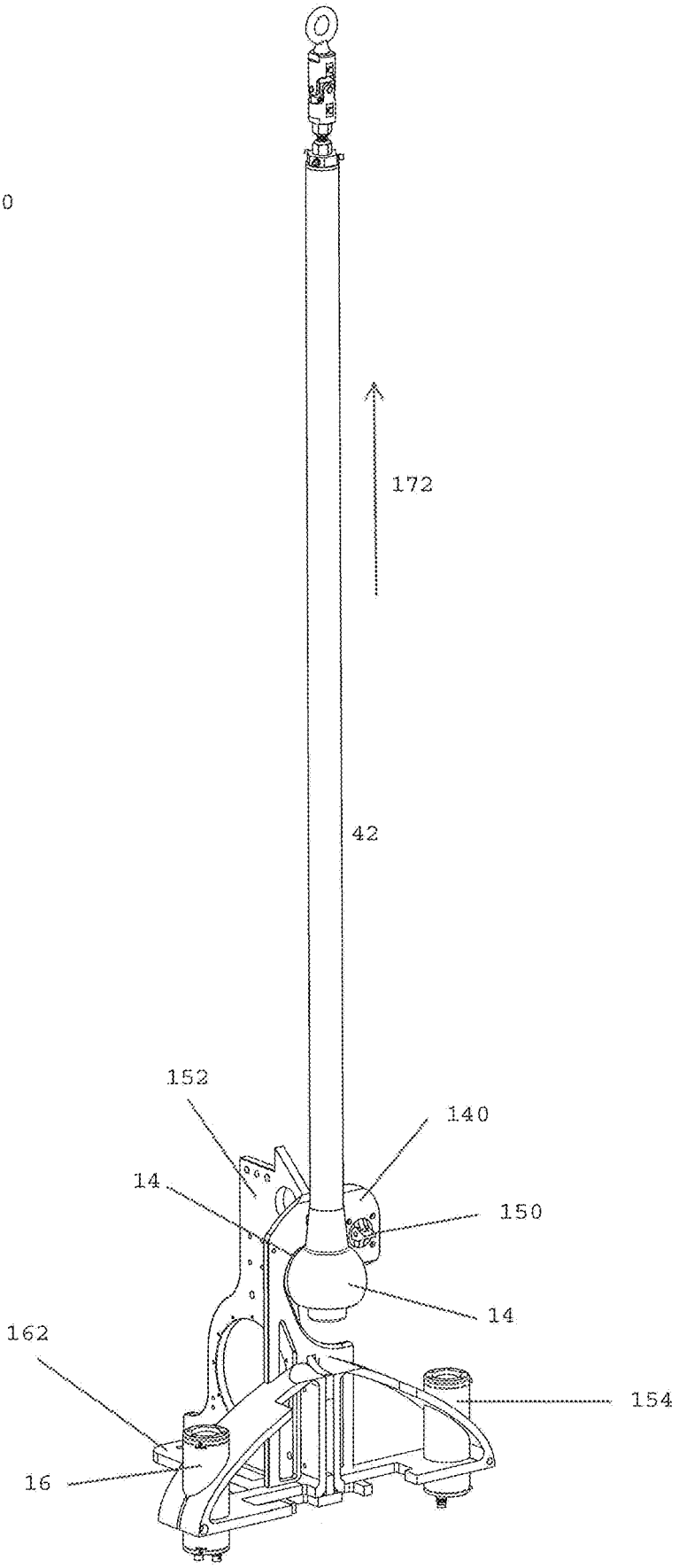
FIG. 20 is a perspective view of the front end of the autonomous underwater vehicle engaged with the docking rod of the present invention with reference to FIG. 4 with certain elements removed for clarity.

FIG. 20 shows a cutaway view of FIG. 4 with only the essential interacting elements. All items are as previously described. AUV 40 has performed a 90-degree pitch up and is hanging vertically below capture sphere 14. In this configuration, docking rod 42 may be raised to the surface by a surface vessel or other fixed or mobile facility while transporting the AUV vertically through an access shaft.

Figure 21:
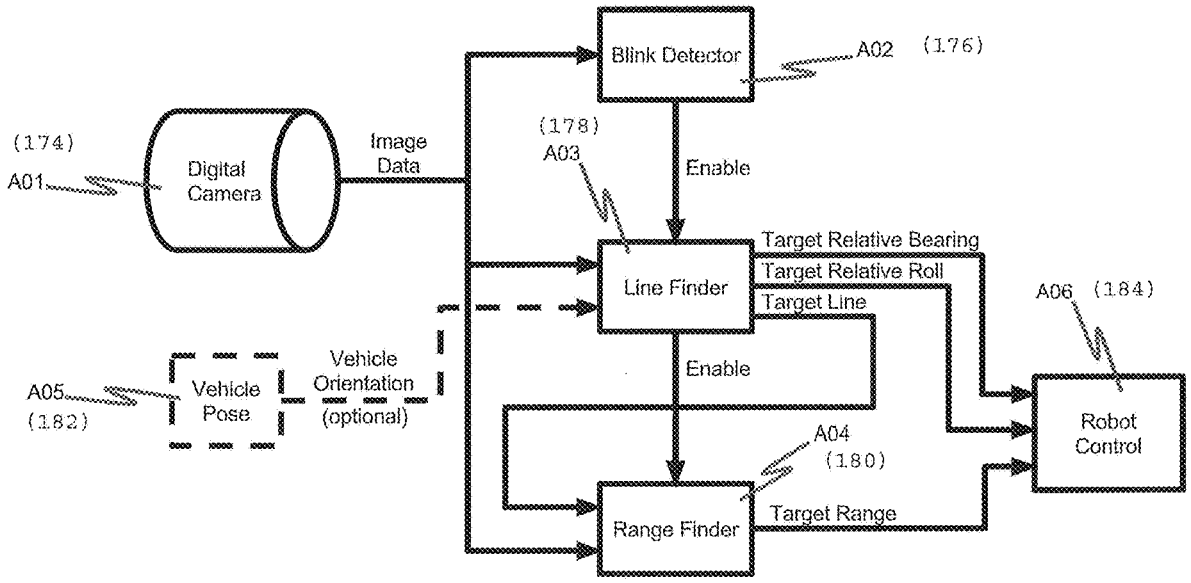
FIG. 21 shows a flow diagram for the docking target detector of the present invention.

Now turning to a discussion of the onboard computational rendezvous and docking algorithm, the Docking Target Detector comprises of a camera (ref. no. 16 in FIG. 2) and three software components, as shown in FIG. 21. The digital video camera A01 (174) generates a stream of digital images, each of which is simultaneously passed to the Blink Detector A02 (176), Line Finder A03 (178), and Range Finder A04 (180) software components.

These components are arranged in an execution hierarchy such that the Blink Detector enables operation of the Line Finder which in turn enables operation of the Range Finder. These software components combine to output the four measured elements of the docking target state: (1) target bearing (relative azimuth); (2) target elevation; (3) target relative roll; and (4) target range. Successful docking requires only the first three elements (azimuth, elevation, and roll). However the range simplifies control and determination of docking success or failure.

Figure 22:
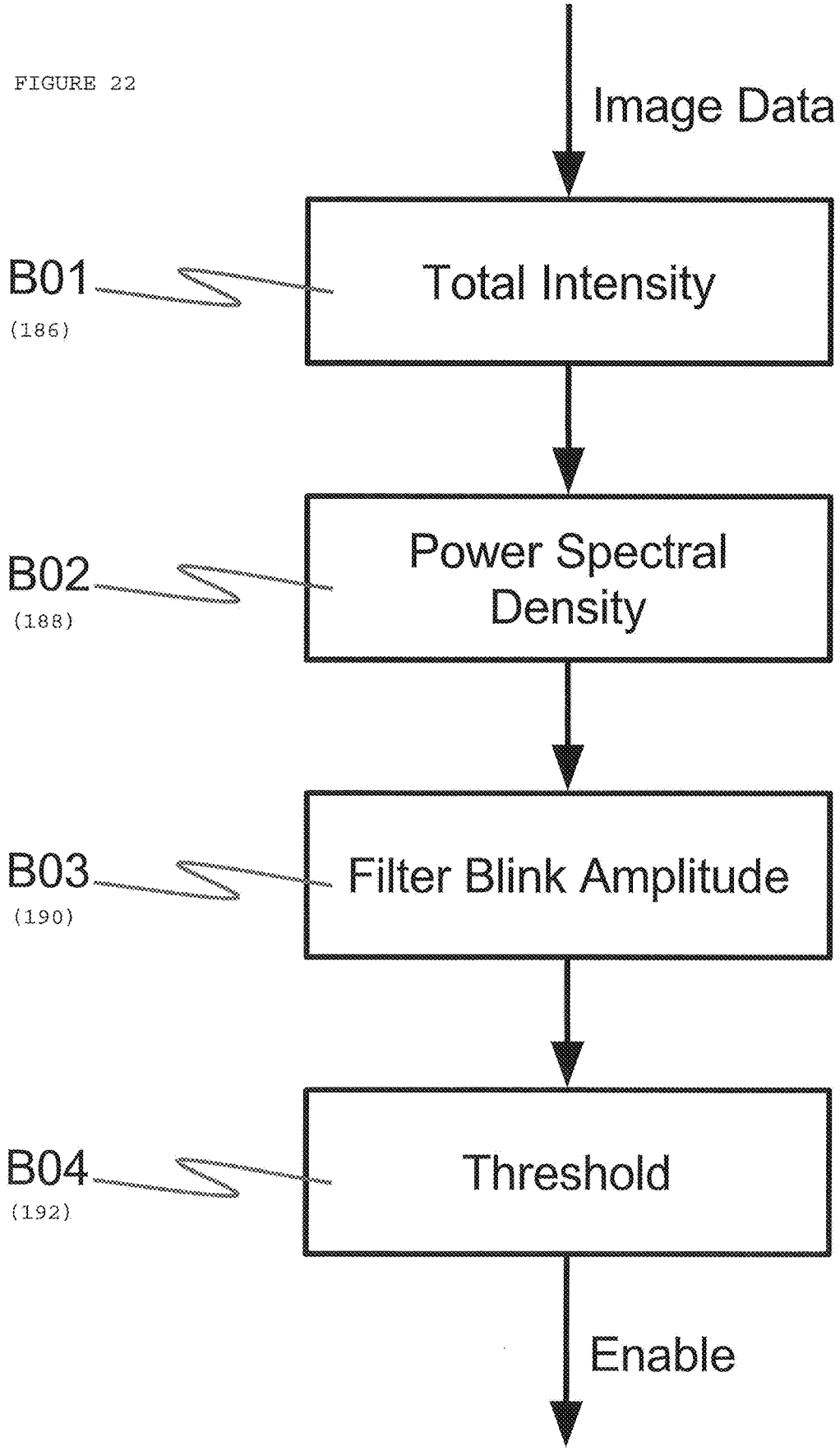
FIG. 22 shows a flow diagram for the operation of the blink detector of the docking target detector of the present invention.

The operation of the Blink Detector A02 (176) is shown in FIG. 22. For every new image received from the digital video camera A01 (174), the Blink Detector performs the following operations to positively identify the presence of the Docking Target Bar in the camera field of view by detecting the predetermined Frequency of Oscillation of the Docking Target Bar.

In step B01 (186, FIG. 22), the total intensity of all pixels in the image is computed. Various methods can be used to determine total intensity, including the sum of all pixel values or a measure of the total image area with intensity over a fixed or adaptive threshold. In step B02 (188), this intensity value is added to a rolling history of intensities whose Power Spectral Density (PSD) is determined by a method such as the Fast Fourier Transform. To enhance the appearance of the Frequency of Oscillation, the history may be de-trended by removing an average of the history values before calculating the PSD. The amplitude of the PSD at the Frequency of Oscillation, or Blink Power is then output to step B03 (190). In step B03 (190), the Blink Power signal is filtered to remove noise and outliers, e.g., using a low-pass filter. In step B04 (192), the filtered Blink Power is thresholded to determine whether a blinking light source is in the camera field of view. If so, the subsequent components are enabled.

Figure 23:
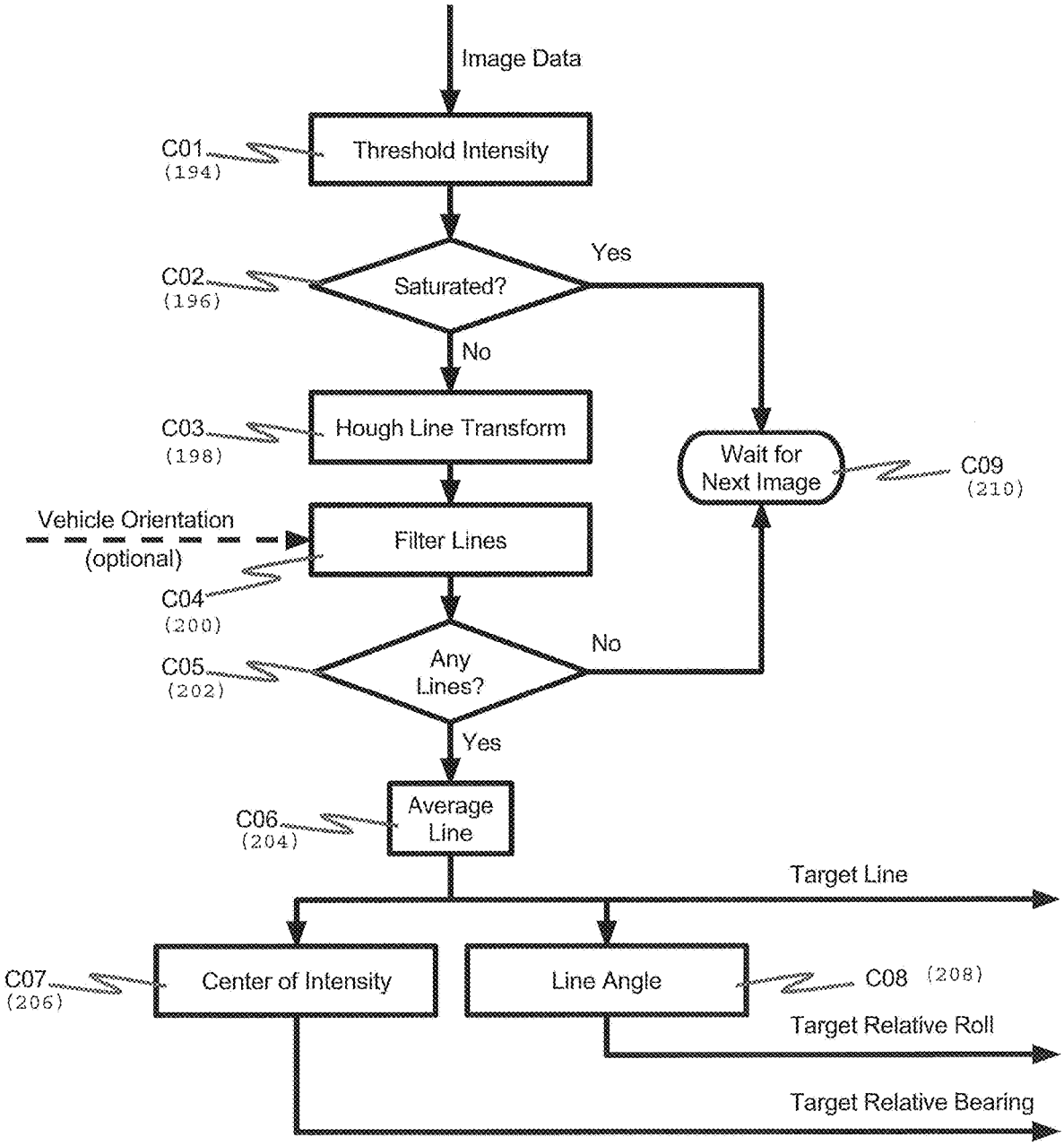
FIG. 23 shows a flow diagram for the operation of the line finder of the docking target detector of the present invention.

The operation of the Line Finder A03 (178, FIG. 21) is shown in FIG. 23. Once enabled by the Blink Detector A02 (176), for every new image received from the digital video camera A01 (174), the Line Finder performs the following operations to find linear lighted features representing the Docking Target Bar and determine the relative roll and bearing (relative azimuth and elevation) of the Docking Target Bar.

In step C01 (194, FIG. 23), the image is converted to a binary bright/dark image using a threshold on intensity. To accommodate changes in background lighting, this threshold may be made adaptive to the range of intensities in the image histogram. In optional step C02 (196), the total bright area in the binary image is computed. If the total bright area exceeds a threshold, the image is deemed saturated or washed out, discarded, and the wait step C09 (210) is activated, otherwise, processing continues to the line extraction step C03 (198). In step C03 (198), the Hough Transform for lines is applied to the binary image to extract linear features. The ensemble of lines found is passed to step C04 (200).

In step C04 (200), the lines are filtered and outliers are rejected. If lines are not sufficiently parallel, they are all rejected. In addition, this step may take advantage of the fact that the construction of the Docking Target Bar helps to ensure that it will always hang near to vertical, so that only lines which align with the local gravity vector can be generated by the target bar. Thus the filtered lines may also be checked for verticality, either by assuming a roll orientation for the camera A01 (174, FIG. 21) based on knowledge of the carrying vehicle (e.g., if it is passively or actively controlled to be upright), or by importing orientation data from the vehicle navigation system A04 (180) (i.e., Range Finder) or inclination sensors.

In step C05 (202, FIG. 23), a check is made to determine whether any valid lines were detected in the field of view. If no lines remain from the extraction step C03 (198) and filtering step C04 (200), the wait step C09 (210) is activated, otherwise processing continues to the line averaging step C06 (204). In step C06 (204), the valid lines from step C04 (200) are averaged to determine a single target line. Averaging can be in the form of mean, median, or mode of line endpoints or point-angle parameters. If processing reached this step, the Target Line has been determined and the Range Finder A04 (180) is enabled.

In step C07 (206), the one-dimensional center of intensity of the Target Line is determined by treating the image intensity to be the density of a region of fixed, narrow width with central axis along the Target Line, and calculating the intensity-weighted centroid thereof. This centroid is considered to be the target bearing, and its azimuth and elevation are computed from the camera intrinsic parameters. In step C08 (208), the target relative roll between the camera A01—and thus the vehicle—and the Target Docking Bar is determined from the angle of the Target Line in the camera image. Step C09 (210) is the wait step. If processing reaches this step, no target could be determined from the image, the Range Finder A04 (180) is disabled, and processing for this component stops until the next image is received.

Figure 24:
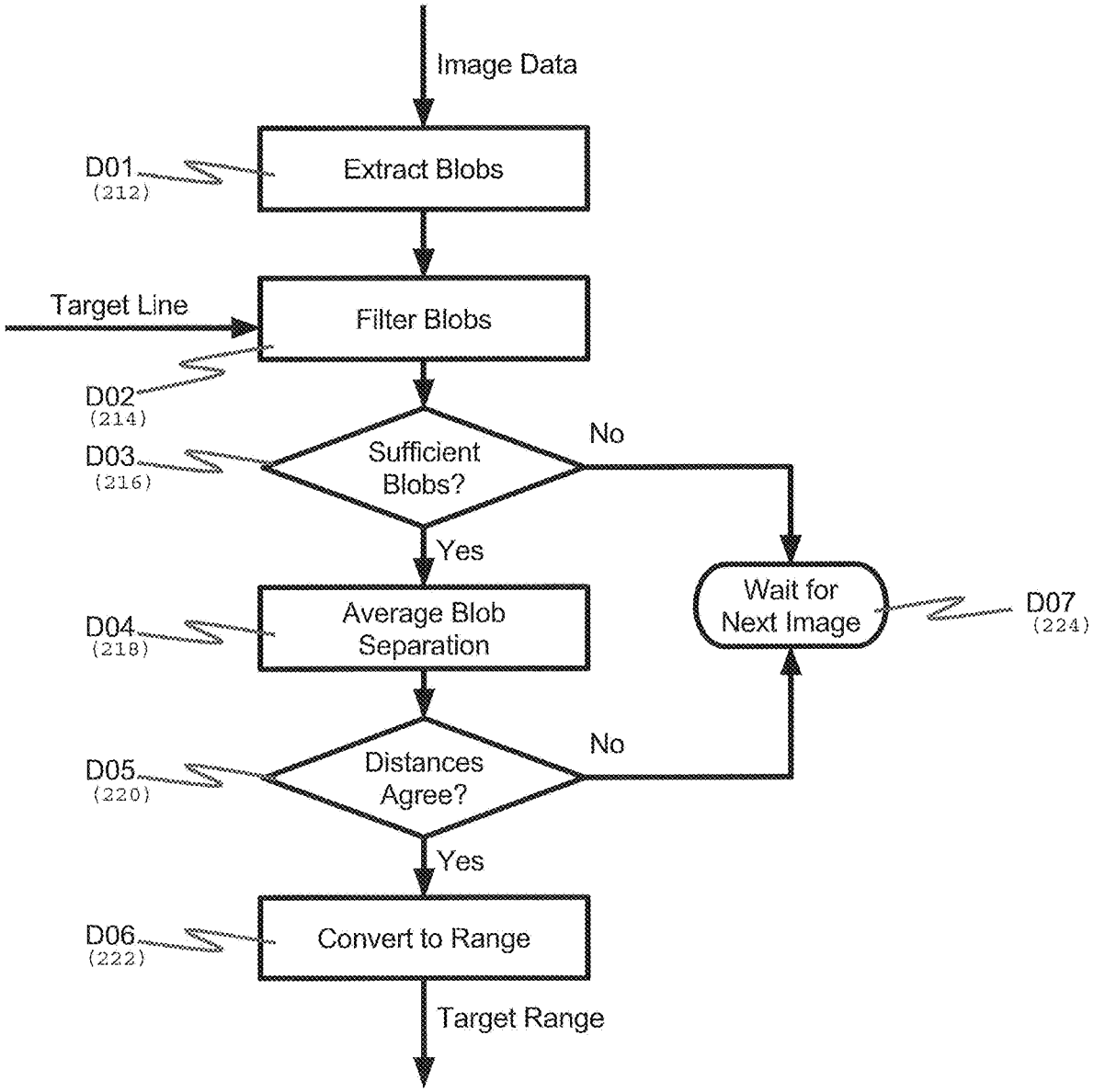
FIG. 24 shows a flow diagram for the operation of the range finder of the docking target detector of the present invention.

Referring now to FIG. 24, the Range Finder operation is shown. Once enabled by the Line Finder A03 (178, FIG. 21), for every new image received from the digital video camera A01 (174), the Range Finder performs the following operations to determine the range to the Docking Target Bar. This range measurement is not required for basic docking operation, but can make the operation more robust to failure by providing feedback for control and an indication of successful capture of the Docking Target Bar or failure. It requires that the lights on the docking bar be distinct and arranged in a known, regular pattern with known spacing. However, docking can proceed even if the Range Finder is unable to determine a target range (i.e., it ends at the wait step C09 [210, FIG. 23]), or is not run at all.

In step D01 (212, FIG. 24), blobs demarcating bright areas in the image are extracted. These can be either pixel groups, contours, or areas. The best method to extract the blobs depends on ambient lighting, the detailed construction of the Target Docking Bar lights, and the reflective and optical properties of the materials used in the Target Docking Bar. These may include local intensity maxima found from spatial gradient methods, pixel groups or contours built from thresholded intensity images (such as that created in step C01 (194) of the Line Finder A03 [178]), pattern matching for the shape via correlation, or any other method which detects separated bright areas in the image.

In step D02 (214, FIG. 24), the blobs are filtered to select only those stemming from lights on the docking rod. If the regular pattern of lights on the rod cannot be distinguished in the image, e.g., due to the range being too great or the water too turbid, this process will cause any blobs that may have been extracted in step D01 (212) to be rejected. The filtering can include any or all of the following sub-steps. First, an area filter, in which those blobs with areas below a minimum threshold or above a maximum threshold, e.g., due to image saturation, are discarded. Next, a shape matching filter in which the blobs are matched to the known geometrical characteristics of lights on the Docking Target Bar, e.g., for individual circular lights, blobs outside a certain bound of circularity are discarded. Finally, a target residual filter in which those blobs whose centroid lies beyond a threshold distance from the Target Line determined by the Line Finder A03 (178) are discarded. Any remaining blobs are passed to step D03 (216).

In step D03 (216), a check is made to determine whether sufficient blobs remain from the extraction step D01 (212) and filtering step D02 (214) to be able to determine the distance between the regular pattern elements. If not, the wait step D07 (224) is activated. Otherwise, processing continues to the distance determination step D04 (218).

In step D04 (218), the spacing between light pattern elements in the image is calculated. This can be an average (generally mean or median) of the distance between centroids of sequential blobs. Pattern matching via a correlation search in scale and rotation can also be used. This step determines a separation and measure of disparity in the separations of the pattern elements—or spacing goodness (e.g., the standard deviation in the sequential centroid distances, or the correlation value from pattern matching).

In step D05 (220), the measure of disparity from step D04 (218) is thresholded. If it is too high, the wait step D07 (224) is activated. Otherwise, processing continues to step D06 (222). In step D06 (222), the pattern separation detected in the image is converted into a range measurement using the known physical separation on the Docking Target Bar and the camera intrinsic parameters. This value is returned by Range Finder as the Target Range. Step D07 (224) is the wait step. If processing reaches this step, the Target Range is set to "unknown" and processing for this component stops until the next image is received.

Figure 25:
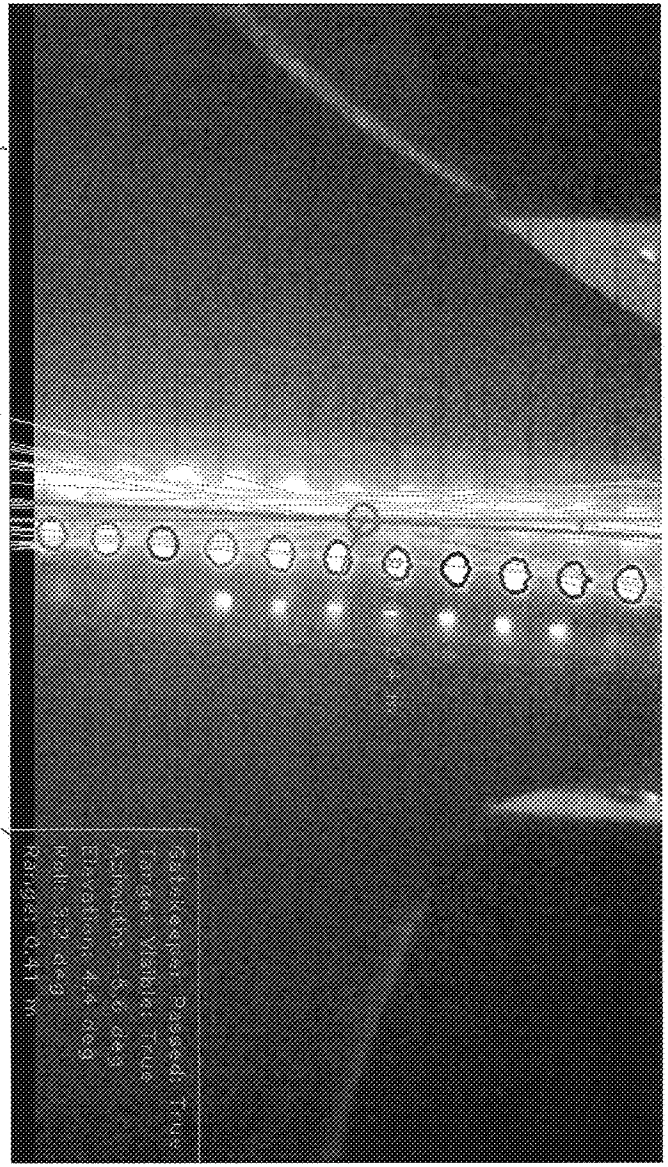
FIG. 25 shows a visual overlay of the parameters of the docking target detector of the present invention over a video frame from a digital video camera.

FIG. 25 shows a visual overlay 300 of the Docking Target Detector Algorithm parameters 310 upon a video frame 312 from digital video camera A01 (174, FIG. 21) during a successful docking sequence and capture of the Docking Target Rod.

Figure 26:
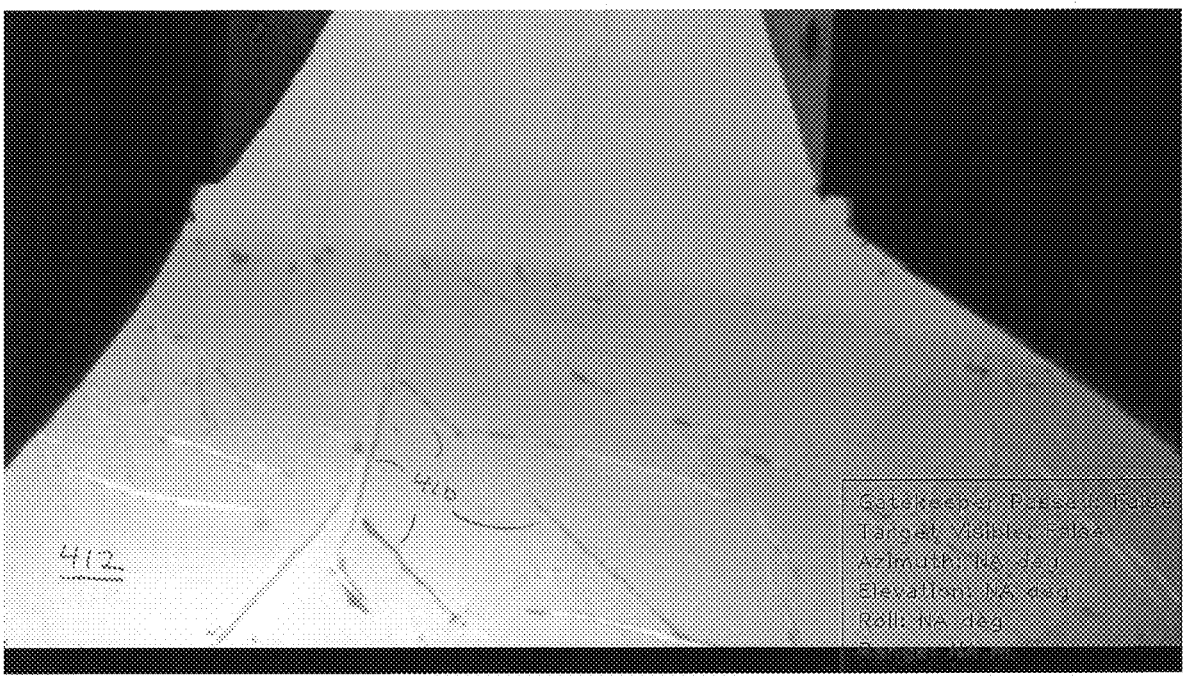
FIG. 26 shows a screenshot of a video stream of the docking target detector in operation.

FIG. 26 shows the robustness of the present invention against false positives in a video stream 400 (even linear elements 410 as shown on the floor 412 of a test tank in FIG. 26), by locking on to the known flashing frequency of the docking target (as shown in FIG. 25). With careful selection, the frequency of oscillation of lighted docking bar 42 can form an extremely effective discriminator against spoofing of the auto-docking algorithm from natural lighting conditions that may exist, e.g., in shallow water or under ice caps, as well as competing man-made lighting conditions (e.g., 60 Hz lights driven on the standard power AC power grid, as well as DC operated lights).

The various embodiments described herein may be used singularly or in conjunction with other similar devices. The present disclosure includes preferred or illustrative embodiments in which a system and method for automated rendezvous, docking, and capture of autonomous underwater vehicles is described. Alternative embodiments of such a system and method can be used in carrying out the invention as claimed and such alternative embodiments are limited only by the claims themselves. Other aspects and advantages of the present invention may be obtained from a study of this disclosure and the drawings, along with the appended claims.

We claim:

1. A method for retrieval of an autonomous underwater vehicle using an automated rendezvous and docking system, the steps of said method comprising;

detecting the presence of a docking rod, said docking rod releasably connected to a suspension cable;

homing said autonomous underwater vehicle toward said docking rod;

orienting said autonomous underwater vehicle such that a docking channel within said autonomous underwater vehicle is parallel to and centered on the vertical linear extent axis of said docking rod;

detecting the range of said docking rod from said autonomous underwater vehicle;

guiding said autonomous underwater vehicle to a closure with the docking rod;

capturing said docking rod within said docking channel of said autonomous underwater vehicle;

acknowledging said capturing of said docking rod;

retrieving said suspension cable and said docking rod to within a few meters of an access hole;

rotating said autonomous underwater vehicle 90° downward until said autonomous underwater vehicle is in vertical alignment with said docking rod; and raising said docking rod and said attached autonomous underwater vehicle to the surface.

2. The method, as recited in claim 1, wherein said homing step is performed by recognizing said docking rod has said vertical linear extent axis.

3. The method, as recited in claim 2, wherein said homing step is further performed by detecting the presence of said vertical linear extent axis.

4. The method, as recited in claim 3, wherein said detecting of the presence of said vertical linear extent axis step is performed by discriminating against all other light sources.

5. The method, as recited in claim 4, wherein said detecting range step is performed with LEDs uniformly spaced at a predetermined spacing.

* * * * *